US006938591B2

(12) United States Patent
Fuwa et al.

(10) Patent No.: US 6,938,591 B2
(45) Date of Patent: Sep. 6, 2005

(54) ELECTROMAGNETICALLY DRIVEN VALVE CONTROL APPARATUS AND METHOD

(75) Inventors: Toshio Fuwa, Nissin (JP); Hiroshi Satou, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 132 days.

(21) Appl. No.: 10/373,812

(22) Filed: Feb. 27, 2003

(65) Prior Publication Data

US 2003/0168029 A1 Sep. 11, 2003

(30) Foreign Application Priority Data

Mar. 11, 2002 (JP) ..... 2002-065801

(51) Int. Cl.[7] ..... F01L 9/04

(52) U.S. Cl. ..... 123/90.11; 251/129.15; 251/129.16

(58) Field of Search ..... 123/90.11; 251/129.15, 251/129.16, 129.01, 129.02

(56) References Cited

U.S. PATENT DOCUMENTS 6,390,039 B2 * 5/2002 Fuwa ..... 123/90.11
6,427,971 B1 * 8/2002 Kawabe et al. ..... 251/129.04
2002/0014213 A1 2/2002 Fuwa

FOREIGN PATENT DOCUMENTS

EP 1 167 725 A2 1/2002
JP A 2000-234534 8/2000
JP A 2001-207875 8/2001
JP A 2001-221022 8/2001
JP A 2001-221360 8/2001

* cited by examiner

*Primary Examiner*—Thomas Denion
*Assistant Examiner*—Ching Chang
(74) *Attorney, Agent, or Firm*—Oliff & Berridge PLC

(57) ABSTRACT

An electromagnetically driven valve control apparatus and method are provided for an electromagnetically driven valve which has a movable element that is driven by cooperation of a spring force and an electromagnetic force, and a valve body engageable with the movable element, and which causes an open-close motion of the valve body due to the movable element engaging with the valve body in accordance with the driving of the movable element. Positional information regarding the movable element is detected, and adjustment of an electromagnetic force for driving the movable element is performed so that the movable element reaches a target operation state based on the positional information detected and a model of the electromagnetically driven valve obtained as a spring-mass vibration system. It is determined whether the movable element is operating in a first state of engagement with the valve body or the movable element is operating in a second state of disengagement from the valve body based on the positional information detected. Changes in a model parameter of the model in the adjustment are determined corresponding to the determined state. Therefore, the control apparatus and method are able to always set suitable model parameter changes in the actual spring-mass vibration system, and are able to improve the precision in the control of the electromagnetically driven valve using an appropriate model.

26 Claims, 14 Drawing Sheets

ELECTROMAGNETICALLY DRIVEN VALVE CONTROL APPARATUS AND METHOD

INCORPORATION BY REFERENCE

The disclosure of Japanese Patent Application No. 2002-065801 filed on Mar. 11, 2002, including the specification, drawings and abstract is incorporated herein by reference in its entirety.

BACKGROUND OF THE INVENTION

1. Field of Invention

The invention relates to an electromagnetically driven valve control apparatus and method.

2. Description of Related Art

Control apparatus for electromagnetically driven valves adopted as intake valves or exhaust valves of internal combustion engines have been proposed. See, e.g., Japanese Patent Application Laid-Open Publication Nos. 2001-207875, 2000-234534, 2001-221022, and 2001-221360. Such control apparatus perform a position control of a movable element so as to achieve a target operation characteristic, for example, a control of changing the velocity of the movable element, or reducing the velocity of the movable element close to "0" at the time of reaching a seated position, or causing the movable element not to reach a seated position when the internal combustion engine is in a specified operation region, in order to reduce the impact noise produced by the movable element.

In conjunction with these technologies, a technology has been proposed in which an electromagnetically driven valve is modeled as a spring-mass vibration system in order to achieve a target operation characteristic as mentioned above. The value of electric current output to electromagnets in order to achieve a target operation characteristic is adjusted on the basis of a physical model in which the mass of the movable portion, the spring constant and the viscosity coefficient are used as model parameters.

In the aforementioned technology, an electromagnetically driven valve control is executed with the model parameters, that is, the mass of the movable element, the spring constant and the viscosity coefficient, being fixed. The electromagnetically driven valve has a movable element that is driven by cooperation of spring force and electromagnetic force, and a valve body that is engageable with the movable element. The electromagnetically driven valve performs open-close actions in which the movable element engages with the valve body in accordance with the driving of the movable element. Therefore, there exist periods during which the movable element is moving in a state of disengagement from the valve body, in addition to the periods during which the movable element is moving in a state of engagement with the valve body.

In the above-described technology, the electromagnetically driven valve control is executed on the basis of the model with the fixed model parameters, assuming that the valve operates in the engaged state all the time while ignoring the period of operation in the disengaged state. Therefore, during the disengaged state operation period, the spring-mass vibration system model deviates from the actual spring-mass vibration system. For example, after the valve body is seated during movement of the movable element toward the closed valve side, the movable element separates from the valve body, so that the actual mass is only the mass of the movable element, and therefore, the actual spring constant is the spring constant of the spring that urges the movable element. Furthermore, the actual viscosity coefficient becomes the viscosity coefficient related to movement of only the movable element. Due to occurrence of such a deviation of the spring-mass vibration system model, the characteristic of electromagnetic force produced by the electromagnets does not correspond to the target operation characteristic, thus giving rise to a problem of degraded precision of the electromagnetically driven valve control.

SUMMARY OF THE INVENTION

It is an object of the invention to improve the precision in the control of an electromagnetically driven valve using a model by making the model parameters, and therefore the model, always suitable corresponding to changes in the spring-mass vibration system of the electromagnetically driven valve. An electromagnetically driven valve control apparatus and method are provided for an electromagnetically driven valve which has a movable element that is driven by cooperation of a spring force and an electromagnetic force, and a valve body engageable with the movable element, and which causes an open-close motion of the valve body due to the movable element engaging with the valve body in accordance with the driving of the movable element.

The electromagnetically driven valve control apparatus includes a controller which detects positional information regarding the movable element, and which performs adjustment of an electromagnetic force for driving the movable element so that the movable element reaches a target operation state based on the positional information detected and a model of the electromagnetically driven valve obtained as a spring-mass vibration system. The controller determines whether the movable element is operating in a state of engagement with the valve body or in a state of disengagement from the valve body, based on the positional information detected, and changes a model parameter of the model in the adjustment corresponding to the determined state (i.e., engaged or disengaged).

In this electromagnetically driven valve control apparatus, since the controller changes the model parameter in the electromagnetic force adjustment in accordance with the engagement and disengagement between the movable element and the valve body, the controller can use an appropriate model corresponding to changes in the actual spring-mass vibration system. Therefore, the driving of the movable element by the controller can be performed with high precision, and the precision in the control of the electromagnetically driven valve using a model can be improved.

The aforementioned "positional information" is a concept that includes information regarding position, such as changes in position, for example, velocity, acceleration, etc., as well as coordinate position.

The aforementioned model can include not only relational expressions that directly express models, but also various relational expressions derived from the aforementioned relational expression, for example, a state observer, an electromagnetic force request value calculating expression derived from the model, etc.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS

In the following description and the accompanying drawings, the present invention will be described in more detail in terms of exemplary embodiments.

Figure 1:
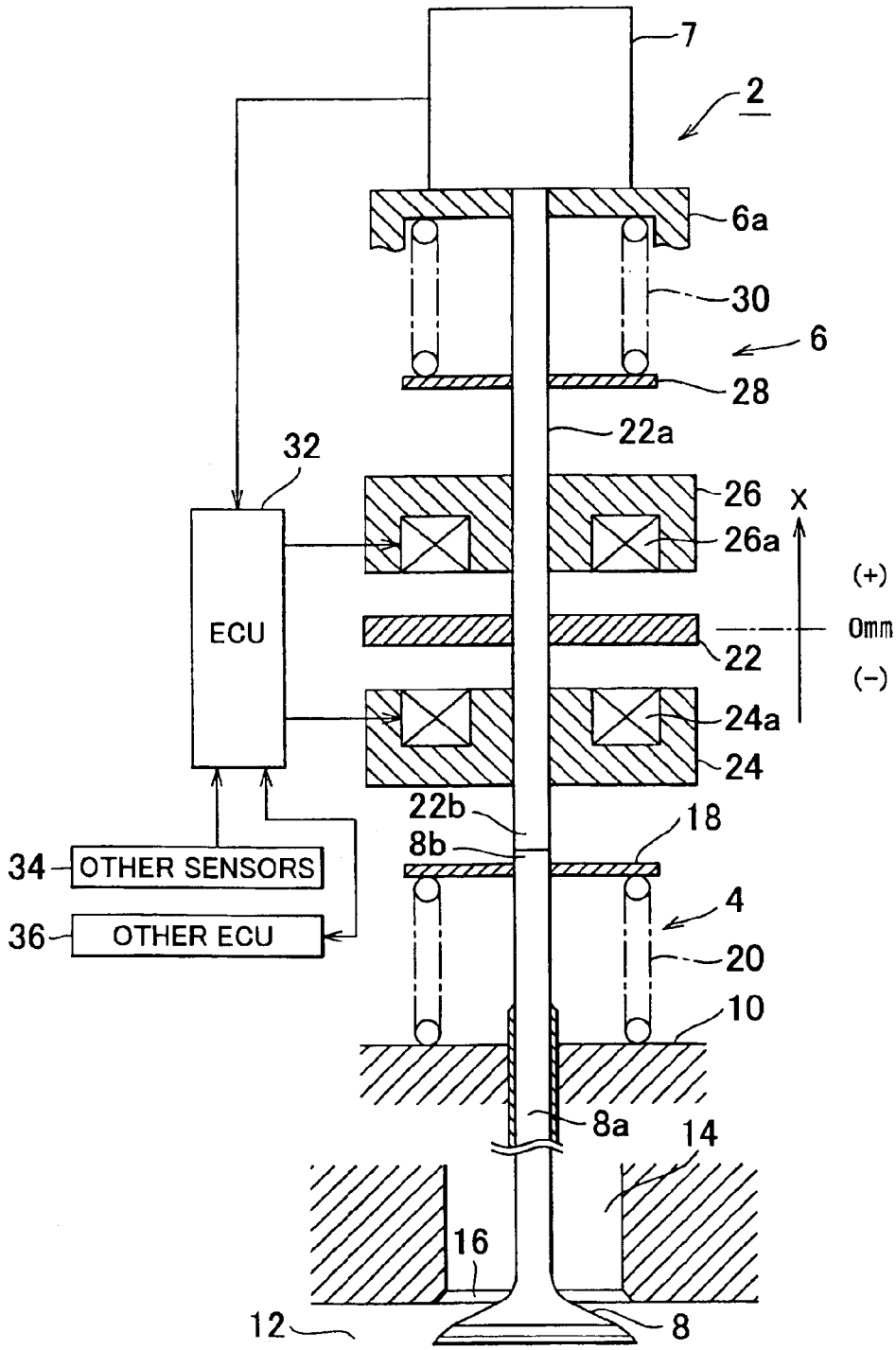
FIG. 1 is a schematic illustration of the construction of an electromagnetically driven valve in accordance with various embodiments of the invention.

FIG. 1 is a schematic illustration of the construction of an electromagnetically driven valve 2 to which the invention is applied. The electromagnetically driven valve 2 is a valve for use as an intake valve or an exhaust valve of an internal combustion engine installed in a vehicle. Since the intake valves and the exhaust valves are identical in a basic construction, the electromagnetically driven valve 2 in FIG. 1 will be described as an intake valve.

The electromagnetically driven valve 2 has a valve portion 4, an electromagnetic drive portion 6, and a displacement sensor portion 7 (which functions as a positional information detection means). The valve portion 4 has a poppet type valve body 8 that is supported on a cylinder head 10 by a valve shaft 8*a* for to-and-fro movements. The cylinder head 10 has an intake port 14 that communicates with a combustion chamber 12. Formed on an opening portion of the intake port 14 on the side of the combustion chamber 12 is a valve seat 16 which the valve body 8 selectively contacts and separates from.

A lower retainer 18 is provided on an end-side portion of the valve shaft 8*a*. A lower spring 20 (corresponding to a second spring) is disposed in a compressed state between the lower retainer 18 and the cylinder head 10. The whole valve body 8 is urged in a closing direction (upward in FIG. 1) by the lower spring 20.

The electromagnetic drive portion 6 has an armature 22 (corresponding to a movable element), a lower core 24, and an upper core 26. The armature 22, the lower core 24 and the upper core 26 are formed from a high-magnetic permeability material. The disc-shape armature 22 has in a central portion thereof an armature shaft 22*a* that extends through a central hole of the lower core 24 and a central hole of the upper core 26 in such a manner as to allow sliding motion of the shaft. The armature shaft 22*a*, extending through the upper core 26, is fixed to an upper retainer 28. An upper spring 30 (corresponding to a first spring) is disposed in a compressed state between the upper retainer 28 and a casing 6*a* of the electromagnetic drive portion 6. The armature shaft 22*a* is urged toward the valve body 8 (downward in FIG. 1) by the upper spring 30.

Therefore, a lower end portion 22*b* of the armature shaft 22*a* and an upper end portion 8*b* of the valve shaft 8*a* contact each other due to the spring forces of the upper spring 30 and the lower spring 20. Thus, the armature 22 and the valve body 8 are engaged with each other as indicated in FIG. 1. In this engaged state, the armature 22 and the valve body 8 are movable together as a single unit. When neither the lower core 24 nor the upper core 26 is magnetized, the armature shaft 22*a* and the valve shaft 8*a* stop at a position of balance between the spring force of the lower spring 20 and the spring force of the upper spring 30. The lower spring 20 and the upper spring 30 are identical springs. A setting is made such that when the armature shaft 22*a* and the valve shaft 8*a* are at the spring force balance position, the armature 22 is at a middle point between the lower core 24 and the upper core 26. FIG. 1 shows the state of balance. The balance position is defined as a zero point of the displacement X of the armature 22, that is, X=0 (mm). The displacement toward the lower core 24 is defined as negative displacement, and the displacement toward the upper core 26 is defined as positive displacement.

A displacement sensor portion 7 is attached to the casing 6*a* of the electromagnetic drive portion 6. The displacement sensor portion 7 detects the displacement X of the armature 22 by detecting the amount of insertion of the armature shaft 22*a* extending through the casing 6*a* and inserted into the displacement sensor portion 7. The displacement sensor portion 7 outputs a displacement signal indicating the displacement X, to an electronic control unit (ECU) 32. The displacement X of the armature 22 represents the position of the unit of the armature 22 and the valve body 8, within the range of the open side (a lower side in FIG. 1) to a completely closed state (where the valve body 8 contacts the valve seat 16). If the armature 22 further moves from the completely closed state toward the closure side (upward in FIG. 1), the valve body 8 remains seated on the valve seat 16, and undergoes no position change. In such a range, the displacement X represents the position of only the armature 22, which has separated from the valve body 8.

Figure 2A:
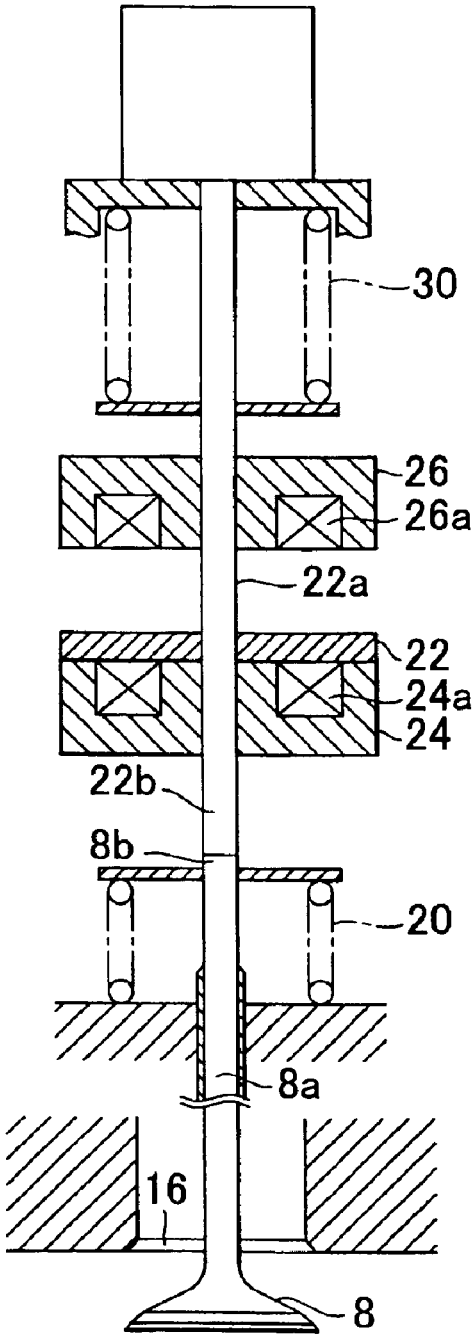
FIG. 2A is a diagram illustrating an open state of the electromagnetically driven valve in various embodiments of the invention.

A lower coil 24*a* is disposed within the lower core 24. An upper coil 26*a* is disposed within the upper core 26. The lower coil 24*a* and the upper coil 26*a* are able to induce the lower core 24 and the upper core 26 to generate electromagnetic forces that attract or hold the armature 22, upon magnetizing currents output from the ECU 32. When a magnetizing current Ilow is supplied to the lower coil 24*a* so that the lower core 24 attracts the armature 22, the armature 22 moves in such a direction that the valve body 8 moves away from the valve seat 16, overcoming the spring force of the upper spring 30 and the spring force of the lower spring 20. Thus, the degree of opening of the intake valve increases. The degree of opening of the intake valve reaches a maximum when the armature 22 contacts the lower core 24. Thus, while the valve body 8 is apart from the valve seat 16, the lower end portion 22*b* of the armature shaft 22*a* remains in contact with the upper end portion 8*b* of the valve shaft 8*a*, and therefore, the armature 22 and the valve body 8 are in a state where the two members move together. FIG. 2A shows a fully open state.

Figure 2B:
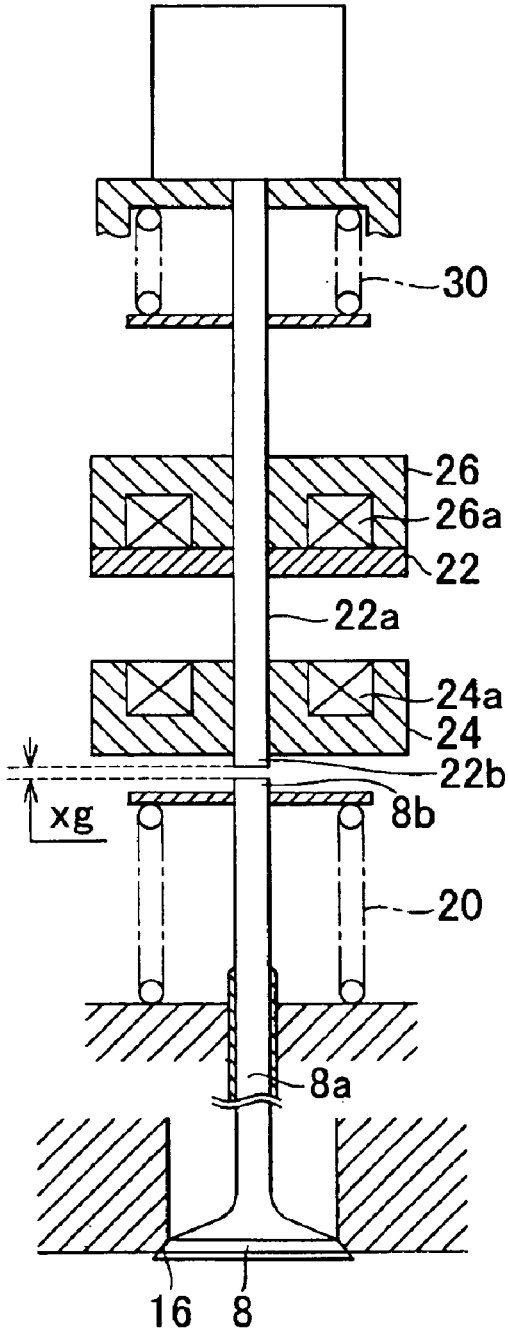
FIG. 2B is a diagram illustrating a closed state of the electromagnetically driven valve in the various embodiments of the invention.

When a magnetizing current Iup is supplied to the upper coil 26*a* so that the upper core 26 attracts the armature 22, the armature 22 moves toward the upper core 26, overcoming the spring force of the upper spring 30. As a result, the valve body 8 moves in such a direction as to approach the valve seat 16, due to the spring force of the lower spring 20. Thus, the degree of opening of the intake valve decreases. As shown in FIG. 2B, when the armature 22 is in contact with the upper core 26, the valve body 8 has already contacted the valve seat 16, that is, the intake valve has been completely closed. In a stage prior to the contact of the armature 22 with the upper core 26, the valve body 8 becomes seated on the valve seat 16. After that, the lower end portion 22*b* of the armature shaft 22*a* separates from the upper end portion 8*b* of the valve shaft 8*a*. In a final stage of closure of the valve (during the movement over a distance xg that is a tappet clearance indicated in FIG. 2B), the spring force of the lower spring 20 does not act on the armature 22, but the armature 22 alone moves upward in the drawings by the electromagnetic force, overcoming the spring force of the upper spring 30.

The ECU 32 is an electronic circuit formed mainly by a microcomputer. The ECU 32 acquires various kinds of information via signals from sensors 34 that include various sensors disposed in the displacement sensor portion 7, the internal combustion engine, etc., and data communications with other ECUs 36 that include an internal combustion engine-purpose ECU, as indicated in FIG. 1. On the basis of such information, the ECU 32 adjusts the magnetizing currents Ilow, Iup supplied to the coils 24*a*, 26*a* so as to execute the control of the driving of the electromagnetically driven valve 2.

Figure 3:
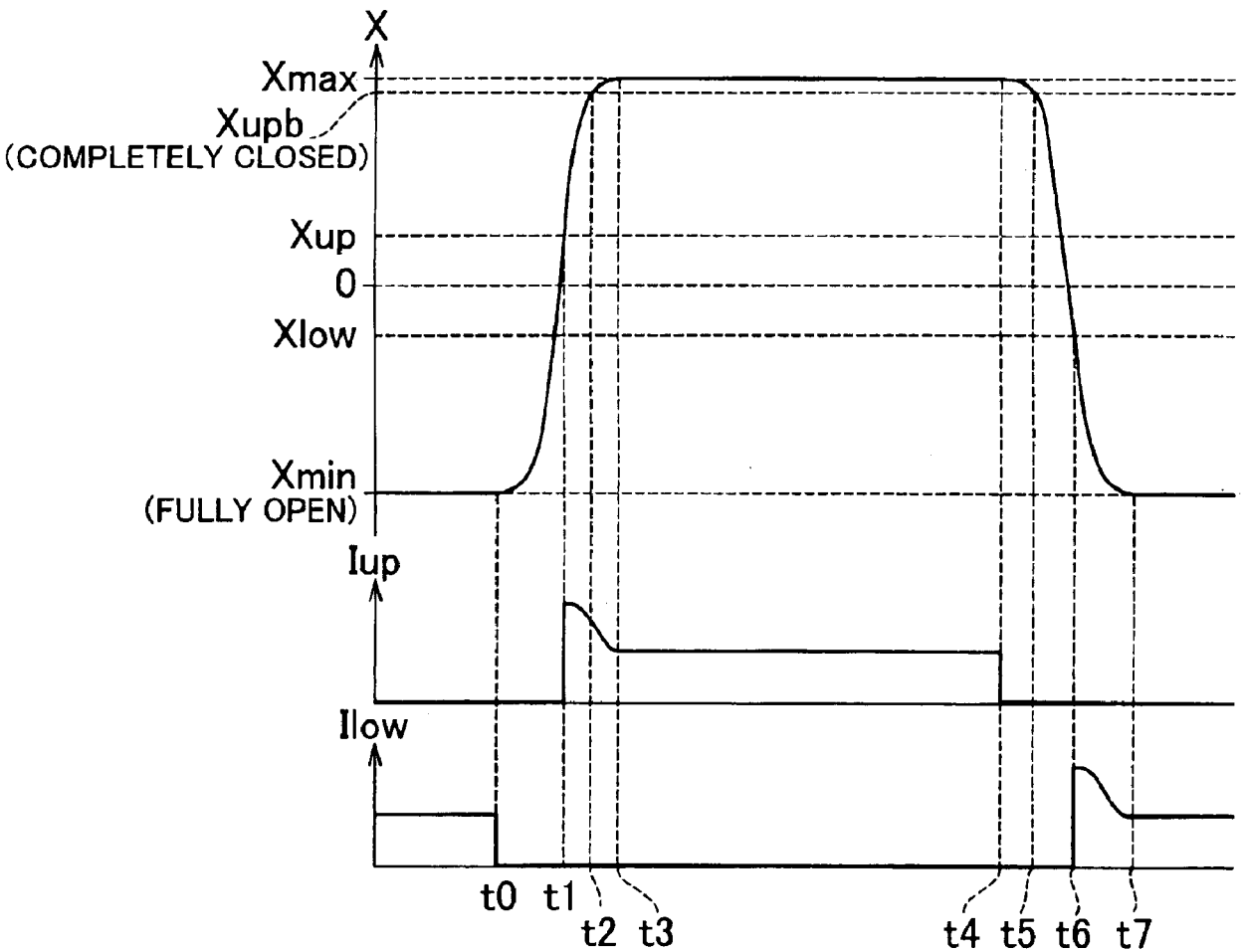
FIG. 3 is a timing chart indicating an example of the driving of the electromagnetically driven valve in accordance with a first embodiment.

The drive control of the electromagnetically driven valve 2 in conjunction with operation of the internal combustion engine is performed by the ECU 32 as exemplified in a timing chart shown in FIG. 3. Although not indicated in the drawings, at the time of startup of the internal combustion engine, the ECU 32 brings the electromagnetically driven valve 2 from the state shown in FIG. 1 to the open valve state or the closed valve state by repetitively supplying the magnetizing current to the lower coil 24*a* and the upper coil 26*a* so as to oscillate the armature 22 and the valve body 8 and gradually increase the amplitude of oscillations thereof.

Prior to a time point t0 in FIG. 3, the armature 22 is in contact with the lower core 24, and is in a hold state as shown in FIG. 2A. If a valve closure request is output by the other ECU 36, the magnetizing current Ilow supplied to the lower core 24 as a hold current is immediately discontinued (time point t0). Therefore, due to the combined spring force of the lower spring 20 and the upper spring 30, the armature 22 and the valve body 8 start to move together as one unit toward the closed valve side (upward in the drawing). When the armature 22 reaches a closing-time passage reference position Xup that is set on an upper core 26-side of the middle point (displacement X=0) between the lower core 24 and the upper core 26 (time point t1), supply of an attraction current as the magnetizing current Iup to the upper coil 26*a* starts, so that the armature 22 is attracted toward the upper core 26. When the displacement X of the armature 22 reaches a maximum displacement Xmax (time point t3), the armature 22 contacts the upper core 26, so that the magnetizing current Iup to the upper coil 26*a* is changed to the hold current. Thus, the armature 22 is held on the upper core 26 (time point t3 to t4). At an intermediate point (time point t2) during the transition of the displacement X of the armature 22 to the maximum displacement Xmax, the valve body 8 becomes seated on the valve seat 16, and therefore completely closed. Thus, the valve body 8 stops. As a result, the armature 22 separates from the valve body 8, and moves in the disengaged state until the maximum displacement Xmax is reached.

When a valve opening request is output by the other ECU 36, the magnetizing current Iup supplied as a hold current to the upper coil 26*a* is immediately discontinued (time point t4). During an initial period (time point t4 to t5), the armature 22 is in the state of disengagement from the valve body 8. Therefore, the armature 22 starts to move toward the open valve side (downward in the drawing) due to the spring force of the upper spring 30 alone. After the lower end portion 22*b* of the armature shaft 22*a* contacts the upper end portion 8*b* of the valve shaft 8*a* (time point t5), the armature 22 is in the state of engagement with the valve body 8, so that the armature 22 and the valve body 8 move together as one unit toward the open valve side (downward in the drawing) due to the spring force of a combined spring of the lower spring 20 and the upper spring 30. When the armature 22 reaches an opening-time passage reference position Xlow that is set on a lower core 24-side of the middle point (displacement X=0) between the lower core 24 and the upper core 26 (time point t6), supply of an attraction current as the magnetizing current Ilow to the lower coil 24*a* starts, so that the armature 22 is attracted toward the lower core 24. When the displacement X of the armature 22 reaches a minimum displacement Xmin (time point t7), the armature 22 contacts the lower core 24, and the magnetizing current Ilow to the lower coil 24*a* is changed to the hold current. Thus, the armature 22 is held on the lower core 24 (from the time point t7 on).

Thus, by causing electromagnetic forces on the armature 22, the ECU 32 is able to control the opening and closing of the intake valve and the degree of opening of the valve to a desired state synchronously with revolution of the internal combustion engine. The operation and advantages also can be achieved in the case of an exhaust valve.

Figure 4:
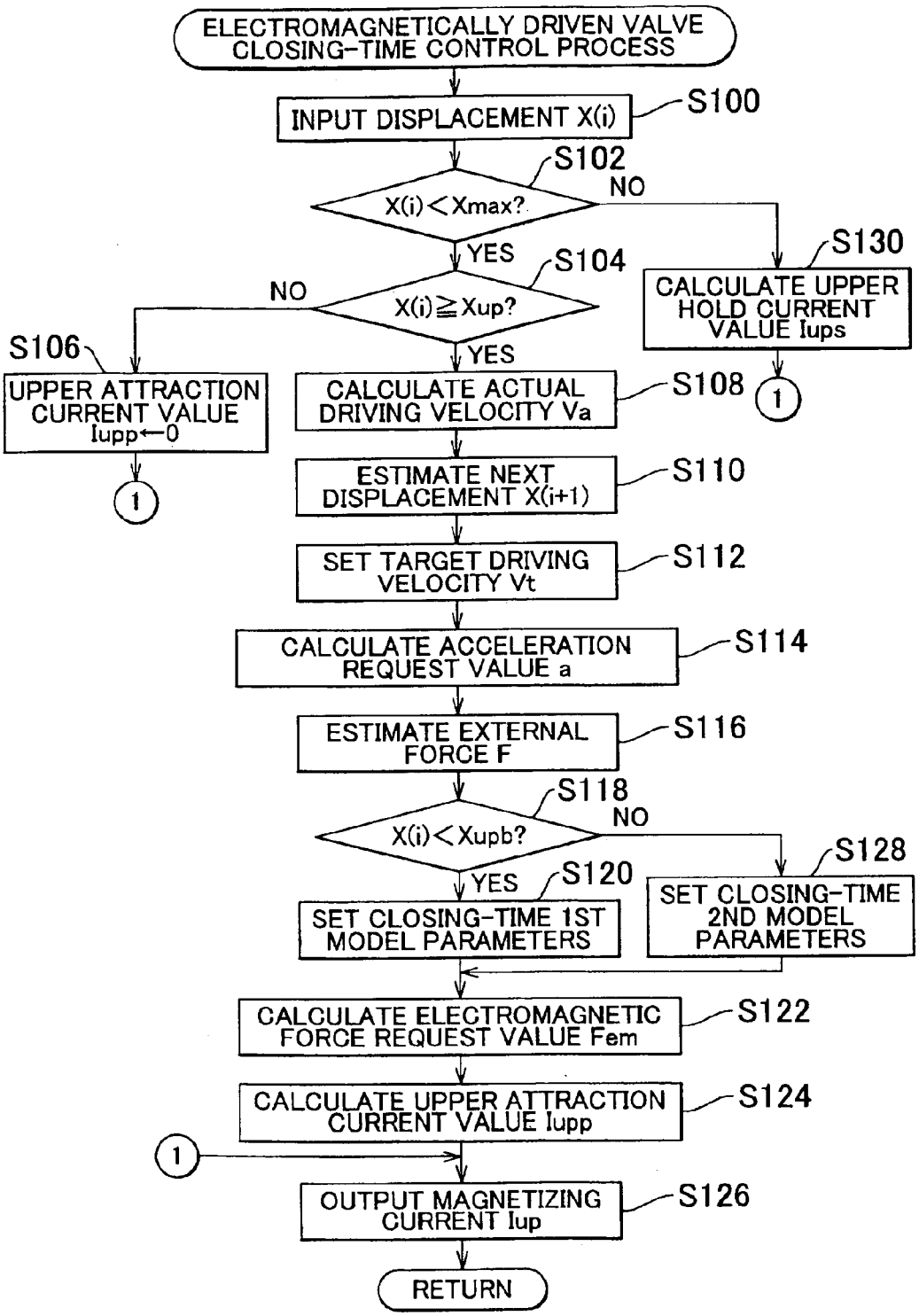
FIG. 4 is a flowchart illustrating an electromagnetically driven valve closing-time control process in the first embodiment.

The process executed by the ECU 32 to supply the magnetizing current to the upper coil 26*a* at the time of closing the valve is illustrated as an electromagnetically driven valve closure-time control process in FIG. 4. The process executed by the ECU 32 to supply the magnetizing current to the lower coil 24*a* at the time of opening the valve is illustrated as an electromagnetically driven valve opening-time control process in FIG. 5. These processes are executed after the startup of the internal combustion engine. The processes are repetitively executed in the cycles of a very short time. Although the processes are illustrated in conjunction with the intake valve, similar electromagnetically driven valve control processes are performed for the exhaust valve.

The electromagnetically driven valve closure-time control process (FIG. 4) started upon discontinuation of the magnetizing current to the lower coil 24*a* in response to a valve closing request will be described. When this process starts, the present displacement X(i) of the armature 22 is input (S100). The displacement X of the armature 22 is constantly calculated by a calculation process that is separately executed on the basis of detection provided by the displacement sensor portion 7. It should be noted herein that the suffix (i) of displacement X indicates the value provided in the present cycle of control.

Next, it is determined whether the displacement X(i) is less than the maximum displacement Xmax indicated in FIG. 3 (S102). If the armature 22 has not reached the upper core 26, that is, X(i)<Xmax, following the discontinuation of the magnetizing current Ilow to the lower coil 24*a* (time point t0 in FIG. 3) ("YES" at S102), it is then determined whether the displacement X(i) is at least the closing-time passage reference position Xup (S104). If X(i)<Xup ("NO" at S104), "0" is set for an upper attraction current value Iupp (S106) in order to maintain the discontinuation of the current to the upper coil 26*a*. Then, on the basis of this upper attraction current value Iupp, a magnetizing current Iup for the upper coil 26*a* is supplied (S126). In this case, since Ipp="0" as mentioned above, the magnetizing current Iup is not supplied (time point t0 to t1 in FIG. 3).

As long as X(i)<Xup ("NO" at S104), the process of steps S100 to S106 is repeated, so that the armature 22 and the valve body 8 in the engaged state move toward the upper core 26, solely by the spring force of the combined spring of the lower spring 20 and the upper spring 30. When X(i) ≧Xup is satisfied ("YES" at S104) as the displacement X(i) increases, an actual driving velocity Va(i) of the armature 22 is calculated as in Expression (1) (S108).

[Mathematical Expression 1]

$$Va(i) \leftarrow \{X(i)-X(i-1)\}/\Delta t \quad (1)$$

In Expression (1), the suffix (i−1) indicates the value acquired in the previous cycle of control. Similarly, the suffix (i+1) mentioned below indicates the value acquired in the subsequent cycle of control. That is, X(i−1) represents the displacement X detected in the previous cycle of control. Furthermore, Δt represents the cycle of control of the process.

Then, the displacement X(i+1) in the subsequent cycle of control is estimated as in Expression (2) (S110).

[Mathematical Expression 2]

$$X(i+1) \leftarrow X(i)+Va(i)\times\Delta t \quad (2)$$

Next, a target driving velocity Vt corresponding to the displacement X(i+1) of the subsequent cycle of control is set with reference to a map V in which the target driving velocity Vt of the armature 22 is set corresponding to the displacement X (S112).

Figure 6:
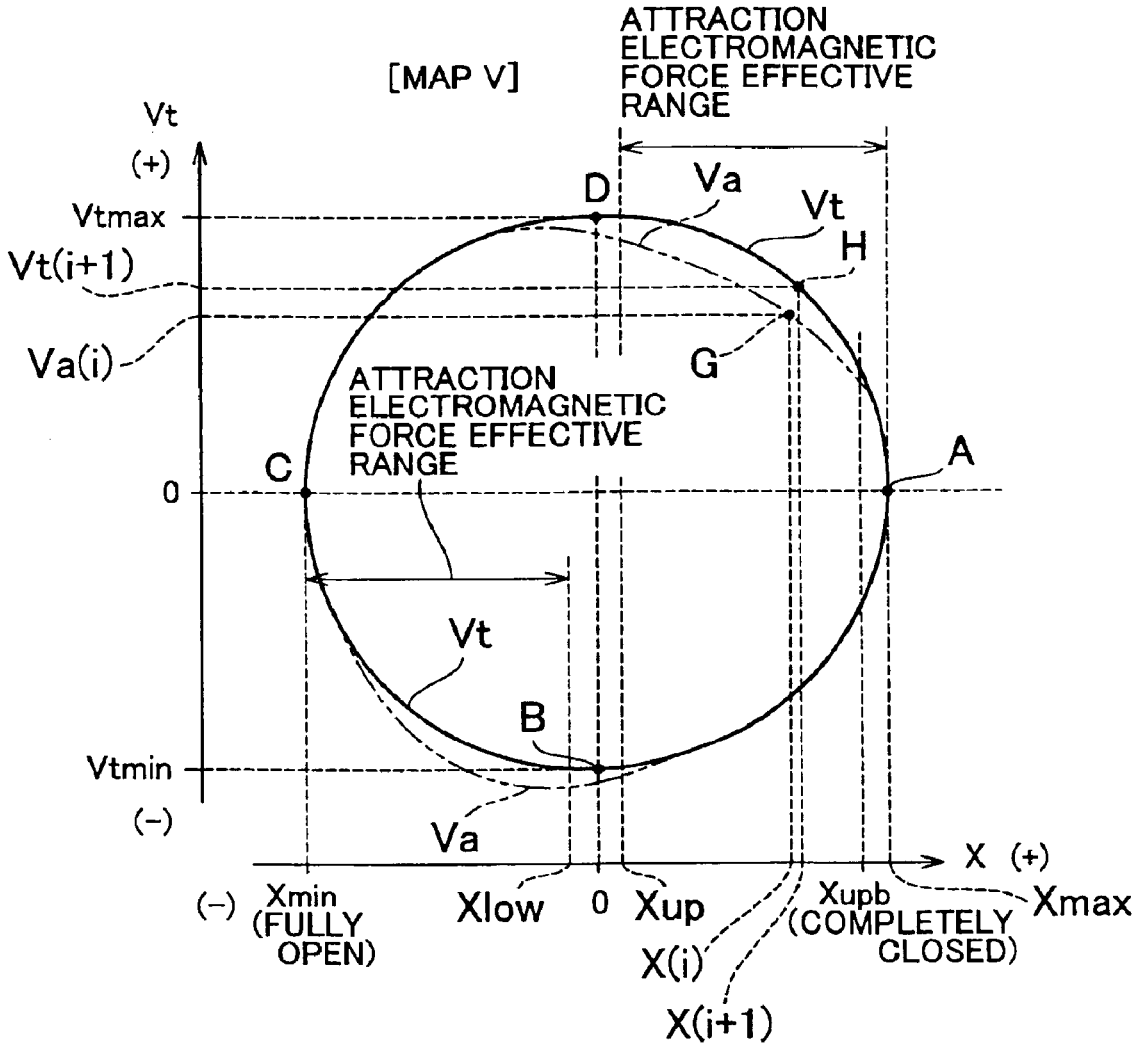
FIG. 6 is an illustration of the arrangement of a map V for setting a target driving velocity Vt in the first embodiment.

The map V is indicated in FIG. 6. This map is stored in a ROM of the ECU 32. As indicated by a solid line in FIG. 6, the target driving velocity Vt for the displacement X of the armature 22 is set in a ring fashion. In the map, a state A is a state where the valve body 8 is already seated on the valve seat 16, and the electromagnetically driven valve 2 is completely closed, and the armature 22 is held on the upper core 26. A state C is a state where the armature 22 is held on the lower core 24, and therefore, the valve body 8 is farthest apart from the valve seat 16, that is, the electromagnetically driven valve 2 is fully open. When the electromagnetically driven valve 2 changes from the completely closed state (state A) to the fully open state (state C), the transition from the state A to the state C occurs via a state B. During the transition from the state A to the state C, the target driving velocity Vt of the armature 22 is negative velocity (downward movement in FIGS. 1 and 2). In this case, the target driving velocity Vt reaches the least value (a maximum in absolute value) when the armature 22 is at the middle point (state B) between the lower core 24 and the upper core 26. When the electromagnetically driven valve 2 changes from the fully open state (state C) to the completely closed state (state A), the transition from the state C to the state A occurs via a state D. During the transition from the state C to the state A, the target driving velocity Vt of the armature 22 is positive velocity. In this case, the target driving velocity Vt reaches the greatest value when the armature 22 is at the middle point (state D) between the lower core 24 and the upper core 26.

For example, if the actual driving velocity Va of the armature 22 at the displacement X(i) is indicated as the velocity corresponding to a state G in FIG. 6, the target driving velocity Vt(i+1) at the displacement X(i+1) in the subsequent cycle of control determined as in the aforementioned expression (2) is indicated as the velocity corresponding to a state H.

The aforementioned map V is not limited to the arrangement indicated in FIG. 6, but may be suitably set in accordance with the kind of the electromagnetically driven valve 2 and performance requirements thereof. In this embodiment, the map is arranged as indicated in FIG. 6 as an example, in view of minimizing the energy loss in driving the electromagnetically driven valve 2 through efficient conversion of the elastic energy stored in the lower spring 20 and the upper spring 30 into kinetic energy.

Next, an acceleration request value a is calculated as in Expression (3) (S114).

[Mathematical Expression 3]

$$a \leftarrow \{Vt(i+1)-Va(i)\}/\Delta t \quad (3)$$

Next, an external force F that acts on the electromagnetically driven valve 2 is estimated as in Expression (4) (S116).

[Mathematical Expression 4]

$$F \leftarrow fa-fb \quad (4)$$

In this expression, fa represents the force that mainly acts on the valve body 8 in accordance with the pressure difference between the in-cylinder pressure (pressure in the combustion chamber 12) and the intake pressure on the intake port 14 side, and is set at, for example, a value that is directly proportional to the pressure difference. If the electromagnetically driven valve 2 is an exhaust valve, the pressure difference is a difference between the in-cylinder pressure and the exhaust pressure.

Furthermore, in Expression (4), fb represents the friction resistance on the slide portion of the electromagnetically driven valve 2, and is a constant value set beforehand through experiments or the like. Since the magnitude of friction resistance changes in accordance with the state of lubrication of the sliding site and, in particular, the temperature of lubricant, the value fb may be increased with decreases in the temperature of the internal combustion engine.

Next, it is determined whether the displacement X(i) of the armature 22 is less than a boundary value Xupb (S118). The boundary value Xupb represents the amount of displacement occurring at a boundary regarding whether the lower end portion 22*b* of the armature shaft 22*a* contacts the upper end portion 8*b* of the valve shaft 8*a*, that is, a boundary regarding whether the armature 22 moves in the state of engagement with the valve body 8 or the state of disengagement from the valve body 8. Assuming that the electromagnetically driven valve 2 is at the position of the state G indicated in FIG. 6, X(i)<Xupb ("YES" at S118). Subsequently, closing-time first model parameters are set as parameters in the expression (Expression (5)) for calculating an electromagnetic force request value Fem mentioned below (S120).

The model parameters in the electromagnetic force request value Fem-calculating expression (Expression 5) are a mass parameter m, a viscosity coefficient parameter c, a spring constant k, and an offset amount xofs. When set as a closing-time first model parameter, the mass parameter m is set to a total mass mp of the armature 22, the valve body 8, the lower spring 20 and the upper spring 30. The mass of the lower spring 20 and the upper spring 30 is not the net mass, but is the mass of the movable portions thereof, and is therefore less than the actual mass of the springs. The viscosity coefficient parameter c is set to a viscosity coefficient cp that occurs when the armature 22 and the valve body 8 move together as one unit. The spring constant k is set to the spring constant kp of the combined spring of the lower spring 20 and the upper spring 30. The offset amount xofs is "0" when set as a closing-time first model parameter.

Values of these parameters are empirically determined beforehand, and are stored in the ROM of the ECU 32.

Next, the electromagnetic force request value Fem is calculated as in Expression (5) (S122).

[Mathematical Expression 5]

$$Fem \leftarrow m \times a + c \times Va(i) + k \times X(i) + k \times xofs - F \quad (5)$$

In this expression, "m×a" represents the force needed to move an object of mass m at the acceleration request value a, and "c×Va(i)" represents the force that occurs as a resistance when an object is moved at the actual driving velocity Va(i), and "k×X(i)" represents the spring force that occurs at the displacement X(i). Furthermore, "k×xofs" represents the spring force that occurs due to offset (offset load), and is "0" in this case. By factoring in the external force F besides the aforementioned forces, the electromagnetic force request value Fem is calculated.

Next, in order to output the electromagnetic force request value Fem, an upper attraction current value Iupp to be supplied to the upper coil 26*a* is calculated (S124). The calculation of the upper attraction current value Iupp is performed with reference to an attraction current map that factors in the electromagnetic force request value Fem and the displacement X(i). The attraction current map is empirically determined beforehand, and is stored in the ROM of the ECU 32. In the attraction current map, the upper attraction current value Iupp tends to be set greater for greater gaps between the armature 22 and the upper core 26, and also tends to be set greater for greater electromagnetic force request values Fem.

On the basis of the upper attraction current value Iupp determined as described above, a magnetizing current Iup for the upper coil 26*a* is supplied (S126). In the later cycles of control, as long as the displacement X(i) is less than the boundary value Xupb ("YES" at S118), an electromagnetic force request value Fem is calculated using the closing-time first model parameters (S120, S122), and the output of the magnetizing current Iup of the corresponding upper attraction current value Iupp (S124, S126) continues (time point t1 to t2).

When the displacement X(i) becomes equal to or greater than the boundary value Xupb ("NO" at S118), closure-time second model parameters are set as model parameters in the electromagnetic force request value Fem-calculating expression (Expression 5) (S128). When set as a closing-time second model parameter, the mass parameter m is set to the total mass ms of the armature 22 and the upper spring 30. In this case, too, the mass of the upper spring 30 is not the net mass thereof, but is the mass of the movable portion of the spring, and is less than the actual mass of the upper spring 30. The viscosity coefficient parameter c is set to the viscosity coefficient cs that occurs when the armature 22 moves. The spring constant k is set to the spring constant ks of the upper spring 30 alone. It should be noted herein that while X(i)>Xupb, the armature shaft 22*a* is apart from the valve shaft 8*a*, and therefore does not receive the spring force of the lower spring 20. Therefore, as a closing-time second model parameter, the offset amount xofs is set to the amount of compression displacement of the upper spring 30 that occurs at the time of a neutral state of the armature 22 as indicated in FIG. 1. These values are empirically determined beforehand, and are stored in the ROM of the ECU 32.

Next, an electromagnetic force request value Fem is calculated as in the aforementioned expression 5 using these parameters (S122). Since xofs>0 at this time, "k×xofs" is not "0".

Then, in order to output the electromagnetic force request value Fem, an upper attraction current value Iupp to be supplied to the upper coil 26*a* is calculated (S124). On the basis of the upper attraction current value Iupp, a magnetizing current Iup for the upper coil 26*a* is supplied (S126). In the later cycles of control, as long as the displacement X(F) is less than the maximum displacement Xmax ("YES" at S102), an electromagnetic force request value Fem is calculated using the closing-time second model parameters (S128, S122), and the output of the magnetizing current Iup of the corresponding upper attraction current value Iupp (S124, S126) continues (time point t2 to t3).

When the displacement X(i) reaches the maximum displacement Xmax ("NO" at S102), an upper hold current value Iups is calculated (S130). The upper hold current value Iups is a value of current that induces the amount of electromagnetic force that stably holds the armature 22 on the upper core 26, overcoming the spring force that occurs at that time (time point t3 to t4) (in this case, the spring force of the upper spring 30 alone "ks×X(i)+ks×xofs"). Then, the upper hold current value Iups is output as a magnetizing current Iup (S126).

Next described will be the electromagnetically driven valve opening-time control process (FIG. 5) that is started upon discontinuation of the supply of the magnetizing current Iup to the upper coil 26*a* in response to the valve opening request (time point t4). When this process starts, the present displacement X(i) of the armature 22 that is separately calculated on the basis of the detection provided by the displacement sensor portion 7 as mentioned above is input (S200).

Figure 5:
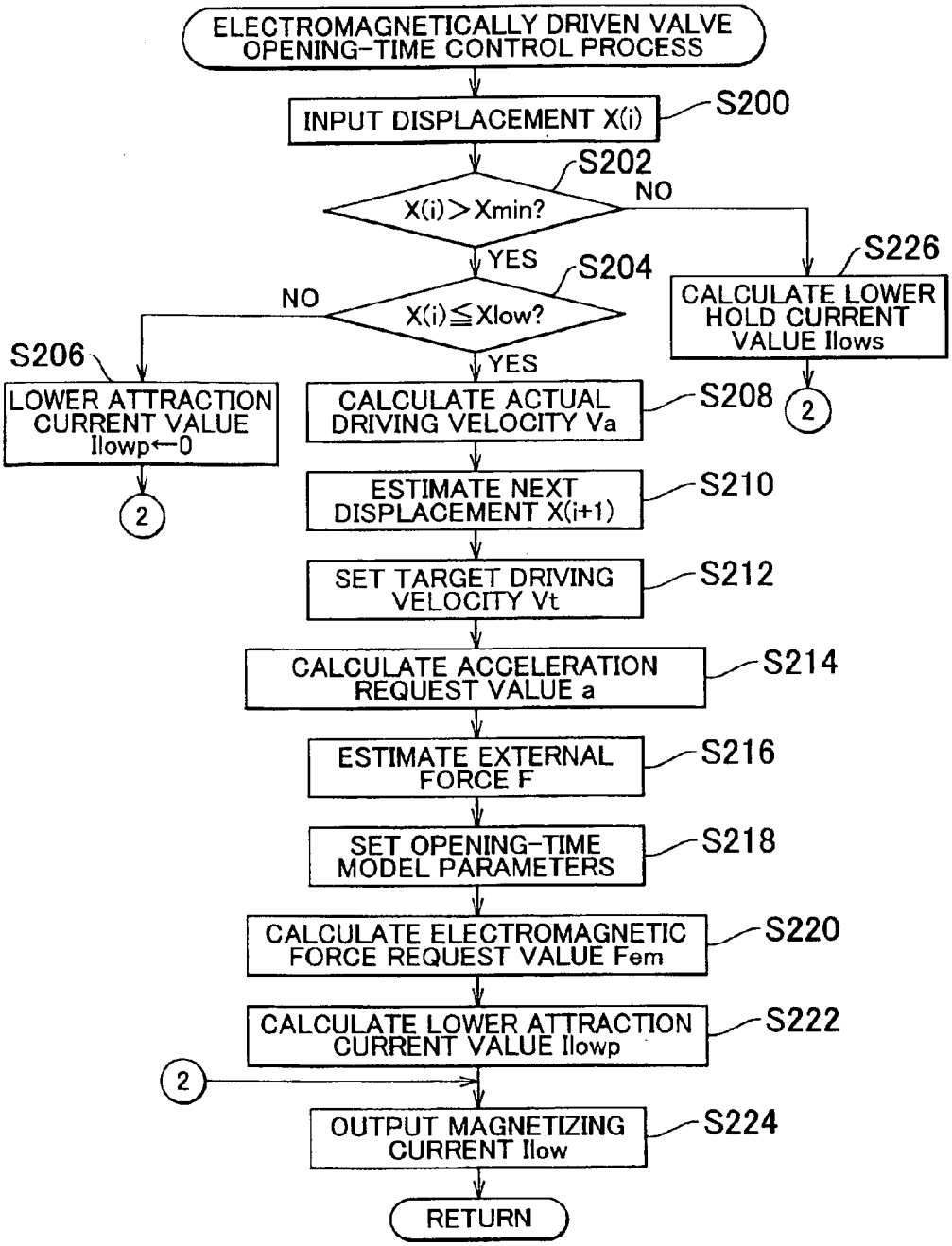
FIG. 5 is a flowchart illustrating an electromagnetically driven valve opening-time control process in the first embodiment.

Subsequently, it is determined whether the displacement X(i) is greater than the minimum displacement Xmin indicated in FIG. 3 (S202). If the armature 22 has not reached the lower core 24 following the discontinuation (time point t5) of the supply of the. magnetizing current Iup to the upper coil 26*a*, that is, X(i)>Xmin ("YES" at S202), it is determined whether the displacement X(i) is at most the opening-time passage reference position Xlow (S204). If X(i)>Xlow ("NO" at S204), the lower attraction current value Ilowp is set at "0" (S206) in order to maintain the discontinuation of the supply of current to the lower coil 24*a*. Next, on the basis of the lower attraction current value Ilowp, a magnetizing current Ilow for the lower coil 24*a* is supplied (S224). In this case, since Ilowp="0", the magnetizing current Ilow is not supplied (time point t4 to t6). At the time of opening the valve, too, the model of the electromagnetically driven valve 2 as a spring-mass vibration system is changed upon contact of the armature shaft 22*a* with the valve shaft 8*a* (time point t5). However, since this timing (time point t5) is within a period during which an attraction control based on the magnetizing current is not performed, a process of changing the model parameters is not performed in the electromagnetically driven valve opening-time control process (FIG. 5).

As long as X(i)>Xlow ("NO" at S204), the process of steps S200 to S206 is repeated. Therefore, the armature 22 moves toward the lower core 24 due to only the spring force of the upper spring 30 until the displacement X(i) reaches the boundary value Xupb. At this time, the valve body 8 is not moving, and the opening of the valve has not started. When the displacement X(i) exceeds the boundary value Xupb, the armature 22 becomes united with the valve body 8, and moves toward the lower core 24 due to the spring force of the combined spring of the lower spring 20 and the upper spring 30, thus starting to open the valve.

When X(i)≦Xlow is satisfied as the displacement X(i) decreases, an actual driving velocity Va(i) of the armature 22 is calculated as in Expression (1) (S208). The content of Expression (1) is described above in conjunction with step S108.

Then, the displacement X(i+1) in the subsequent cycle of control is estimated as in Expression (2) (S210). Subsequently, with reference to the aforementioned map V (FIG. 6), a target driving velocity Vt corresponding to the displacement X(i+1) of the subsequent cycle of control is set (S212). After that, an acceleration request value a is calculated as in Expression (3) (S214). After that, an external force F that acts on the electromagnetically driven valve 2 is estimated as in Expression (4) (S216).

Next, opening-time model parameters in the electromagnetic force request value Fem-calculating expression (5) are set (S218). Since the armature 22 is already in the state where the armature 22 and the valve body 8 move together as one unit, the opening-time model parameters are set as mentioned in conjunction with step S120. That is, the mass parameter m is set to the mass mp, and the viscosity coefficient parameter c is set to the viscosity coefficient cp, and the spring constant k is set to the spring constant kp, and the amount of offset xofs is set to "0". That is, the same parameters as the closing-time first model parameters are set.

Next, an electromagnetic force request value Fem is calculated as in Expression (5) (S220). Then, in order to output the electromagnetic force request value Fem, a lower attraction current value Ilowp to be supplied to the lower coil 24*a* is calculated (S222). Similar to the upper attraction current value Iupp mentioned in conjunction with step S124, the lower attraction current value Ilowp is determined with reference to an attraction current map that factors in the electromagnetic force request value Fem and the displacement X(i).

On the basis of the lower attraction current value Ilowp determined as described above, a magnetizing current Ilow for the lower coil 24*a* is supplied (S224). In the later cycles of control, as long as the displacement X(i) is less than the minimum displacement Xmin ("YES" at S202), an electromagnetic force request value Fem is calculated using the opening-time model parameters (S218, S220), and the output of the magnetizing current Ilow of the corresponding lower attraction current value Ilowp (S222, S224) continues (time point t6 to t7).

When the displacement X(i) reaches the minimum displacement Xmin ("NO" at S202), a lower hold current value Ilows is calculated (S226). The lower hold current value Ilows is a value of current that induces the amount of electromagnetic force that stably holds the armature 22 on the lower core 24, overcoming the spring force that occurs at this time (time point t7 and later) (in this case, the spring force "kp×X(i)" of the lower spring 20 and the upper spring 30). Then, the lower attraction current value Ilowp is output as a magnetizing current Ilow (S224).

In the above-described first embodiment, the displacement sensor portion 7 functions as a positional information detection means, and steps S118, S120, S128 in the electromagnetically driven valve closing-time control process (FIG. 4) and step S218 in the electromagnetically driven valve opening-time control process (FIG. 5) function as a model parameter changing means. Furthermore, the electromagnetically driven valve closing-time control process (FIG. 4) and the electromagnetically driven valve opening-time control process (FIG. 5) excluding steps S118, S120, S128 and S218 function as an electromagnetic force adjusting means.

The above-described first embodiment achieves the following advantages.

(a) The period (time point t1 to t2) during which the armature 22, that is, a movable element, is operating in the state of engagement with the valve body 8, and the period (time point t2 to t3) during which the armature 22 alone is operating in the state of disengagement from the valve body 8 are determined on the basis of the information regarding the position of the armature 22 (S118), and the model parameters are changed (S120, S128). Therefore, the model parameters can always be set in a suitable manner corresponding to changes in the actual spring-mass vibration system. Hence, the precision of the control of the electromagnetically driven valve 2 using a model can be improved.

(b) The changing of the parameters is performed with respect to all the parameters of mass, viscosity coefficient, spring constant and offset. Therefore, the model parameters can be sufficiently accurately set corresponding to changes in the actual spring-mass vibration system. Hence, the precision of the control of the electromagnetically driven valve 2 using a model can be considerably improved.

Figure 7:
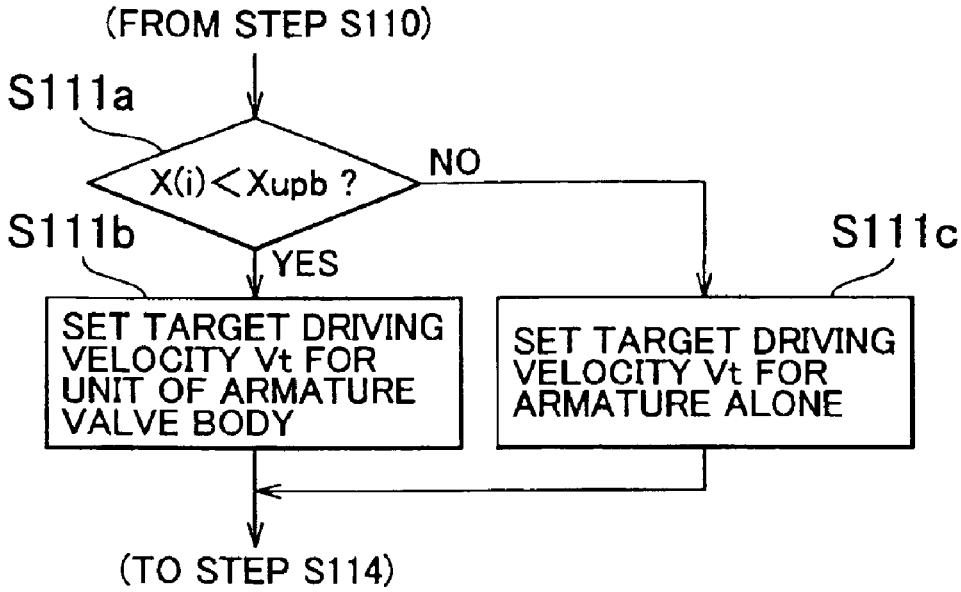
FIG. 7 is a flowchart illustrating a portion of an electromagnetically driven valve closing-time control process in a second embodiment.
Figure 8:
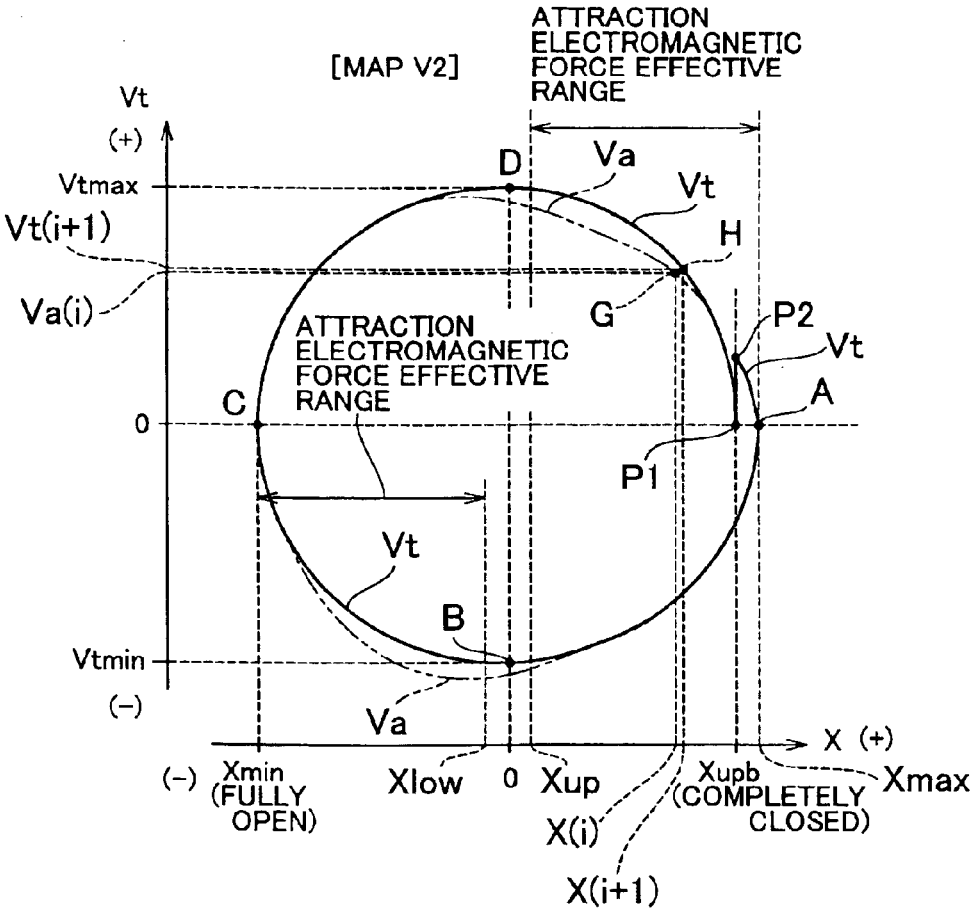
FIG. 8 is an illustration of the arrangement of a map V2 for setting a target driving velocity Vt in the second embodiment.

A second embodiment of the invention will next be described. In the second embodiment, a process illustrated in FIG. 7 is performed in place of step S112 in the electromagnetically driven valve closing-time control process illustrated in FIG. 4. Furthermore, a map V2 indicated in FIG. 8 is used instead of the map V indicated in FIG. 6. In the other respects, the second embodiment is the same as the first embodiment.

In the map V2 (FIG. 8), during a period of increases in the displacement X(i) in the state transition D→A during the valve-closing drive period, the target driving velocity Vt temporarily becomes "0" (mm/sec) (state P1) when the displacement X equals the boundary value Xupb at which the armature 22 separates from the valve body 8. At the time of the boundary value Xupb, another target driving velocity Vt (>0) is set (state P2). From the state P2, the target driving velocity Vt decreases again as the displacement X(i) increases. At the time of the state A, the target driving velocity Vt becomes "0" (mm/sec). With respect to the other valve-closing drive period (state C→D) and the valve-opening drive period (state A→B→C), the map V2 is the same as the map V (FIG. 6).

In the electromagnetically driven valve closing-time control process, the displacement X(i+1) of the subsequent cycle of control is estimated as in Expression (2) in step S110 (FIG. 4), and then it is determined whether the present displacement X(i) of the armature 22 is less than the boundary value Xupb (S111*a* in FIG. 7). If X(i)<Xupb ("YES" at S111*a*), the armature 22 is in the state of moving the valve body 8. Therefore, a target driving velocity Vt is determined on the basis of the displacement X(i+1) estimated by a portion of the armature-valve body united state (state C-P1) in the map V2 (FIG. 8).

However, there is a case where although the displacement X(i) is in the range of the armature-valve body united state (state C-P1), the estimated displacement X(i+1) is within the range (state P2-A) in which the armature 22 is moving along in the state of disengagement from the valve body 8. In such a case, the target driving velocity Vt is set to a target driving velocity that occurs at the state P1 ("0" in this case).

Other processes are also possible. For example, since the control cycle is sufficiently short, the map of the state P2-A may be directly applied if the estimated displacement X(i+1) is within the range (state P2-A) where the armature 22 is moving alone. In this manner, too, the velocity of the unit of the armature 22 and the valve body 8 can be made sufficiently close to "0" before the displacement X(i) reaches the boundary value Xupb.

After the target driving velocity Vt is set in step S111*b*, an acceleration request value a is calculated as in Expression (3) on the basis of the target driving velocity Vt and the actual driving velocity Va(i) (S114 in FIG. 4). After that, the process as described above in conjunction with the first embodiment is executed (S116 to 126 in FIG. 4).

Therefore, as long as X(i)<Xupb ("YES" at S111*a*), the magnetizing current Iup through the upper coil 26*a* is adjusted so that the unit of the armature 22 and the valve body 8 stops at the boundary value Xupb.

When X(i)≧Xupb is established ("NO" at S111*a*), a target driving velocity Vt (>0) is set based on a portion of the state P2-A in the map of FIG. 8 (S111*c*). Then, on the basis of this target driving velocity Vt and the actual driving velocity Va(i), an acceleration request value a is calculated as in Expression (3) (S114 in FIG. 4). After that, the process as described in conjunction with the first embodiment (S16, S118, S128, S122–S126 in FIG. 4) is executed.

Therefore, when the displacement X(i) reaches the boundary value Xupb, the armature 22 moves toward the upper core 26 at increased actual driving velocity Va(i). The magnetizing current Iup of the upper coil 26*a* is adjusted so that the actual driving velocity Va(i) of the armature 22 becomes "0" at the position of contact of the armature 22 with the upper core 26 (state A).

Figure 9:
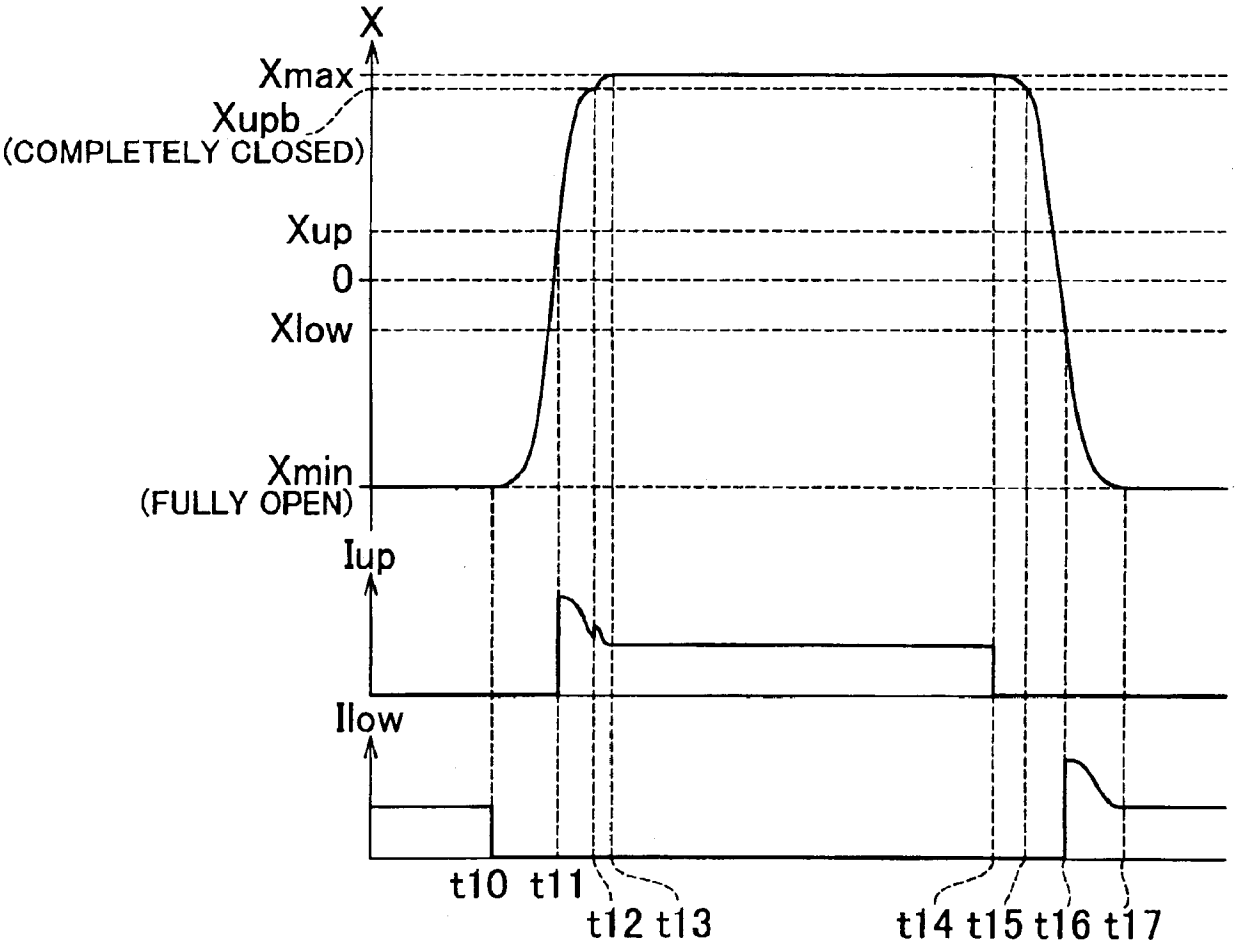
FIG. 9 is a timing chart indicating an example of the driving of the electromagnetically driven valve in the second embodiment.

Due to the above-described process, the armature 22 moves between the lower core 24 and the upper core 26 as indicated in a timing chart shown in FIG. 9. That is, when the supply of the hold current to the lower coil 24*a* is discontinued (t10), the unit of the armature 22 and the valve body 8 starts moving toward the upper core 26 due to the spring force of the combined spring of the lower spring 20 and the upper spring 30, so that the displacement X increases. Then, when the displacement X exceeds the closing-time passage reference position Xup (t11), the magnetizing current Iup is supplied to the upper coil 26*a* in accordance with the upper attraction current value Iupp calculated on the basis of the aforementioned closing-time first model parameters. The upper attraction current value Iupp is adjusted so as to achieve the target driving velocity Vt indicated between the closing-time passage reference position Xup and the state P1 in the map V2 (FIG. 8). Therefore, control is performed such that the actual driving velocity Va becomes "0" at the position where the displacement X becomes equal to the boundary value Xupb. At the position of the boundary value Xupb, the unit of the armature 22 and the valve body 8 temporarily stops or approximately stops (t12). Exactly at this position, the valve body 8 contacts the valve seat 16. Therefore, the impact of the valve body 8 on the valve seat 16 is reduced, and impact noise can be prevented.

Then, when the displacement X becomes equal to or slightly greater than the boundary value Xupb (time point t12 and later), the target driving velocity Vt becomes positive value again due to adoption of the map of the state P2-A. Therefore, the moving speed of the armature 22 toward the upper core 26 increases. At this time, the armature 22 moves alone in the state of separation from the valve body 8, and therefore, the magnetizing current Iup is supplied to the upper coil 26*a* in accordance with the upper attraction current value Iupp calculated (S128, S122, S124) on the basis of the aforementioned closing-time second model parameters. Since the upper attraction current value Iupp is adjusted so as to achieve the target driving velocity Vt indicated between the state P2 and the state A in the map V2 (FIG. 8), the target driving velocity Vt becomes "0" (state A) at the position where the displacement X reaches the maximum displacement Xmax. The armature 22 thus stops (t13). Exactly at this stop position, the armature 22 contacts the upper core 26. Therefore, impact of the armature 22 on the upper core 26 is reduced, and impact noises can be prevented.

After that, the state where the armature 22 is in contact with the upper core 26 is maintained by the hold current supplied to the upper coil 26*a* (t13 to t14). Then, when the supply of the hold current to the upper coil 26*a* is discontinued in order to open the valve, the armature 22 starts to move toward the lower core 24 due to the same process as the electromagnetically driven valve opening-time control process (FIG. 5). During the movement, the armature 22 contacts the valve body 8, and becomes engaged with the valve body 8 (t15), so that the unit of the armature 22 and the valve body 8 moves toward the lower core 24. After that (t16 and later), an attraction current is supplied to the lower coil 24*a*, so that the armature 22 is attracted toward the lower core 24. When the displacement X reaches the minimum displacement Xmin (t17), the velocity of the unit of the armature 22 and the valve body 8 becomes "0". The unit of the armature 22 and the valve body 8 thus stops. At the position of the minimum displacement Xmin, the armature 22 contacts the lower core 24. Therefore, the impact of the armature 22 on the lower core 24 is reduced, and the impact noises can be prevented.

It should be noted that at the time point during the valve-opening drive at which the armature 22 contacts the valve body 8, and becomes engaged therewith, the target driving velocity Vt of the armature 22 is not brought to "0". The reason for this operation is as follows. That is, during the valve-opening drive, the armature 22 contacts the valve body 8 shortly after starting to move. Therefore, the velocity of the armature 22 at the time of contact with the valve body 8 is relatively low, and the noise of impact of the armature 22 on the valve body 8 tends to be low.

In the above-described second embodiment, the displacement sensor portion 7 functions as a positional information detection means, and steps S118, S120, S128 in the electromagnetically driven valve closing-time control process (FIGS. 4 and 7) and step S218 in the electromagnetically driven valve opening-time control process (FIG. 5) function as a model parameter changing means. Furthermore, the electromagnetically driven valve closing-time control process (FIGS. 4 and 7) and the electromagnetically driven valve opening-time control process (FIG. 5) excluding steps S118, S120, S128 and S218 function as an electromagnetic force adjusting means.

The above-described second embodiment achieves the following advantages.

(a) The advantages (a) and (b) of the first embodiment are achieved.

(b) During the valve-closing drive, the control apparatus of the second embodiment executes both the process of controlling the velocity of the armature 22 engaged with the valve body 8 to "0" at the time of contact of the valve body 8 with the valve seat 16, and the process of controlling the velocity of the armature 22 moving alone to "0"at the time of contact with the upper core 26. As for the two processes, by changing the model parameters, high-precision drive control of the electromagnetically driven valve 2 can be preformed. Therefore, impact noise can be remarkably reduced.

Figure 10:
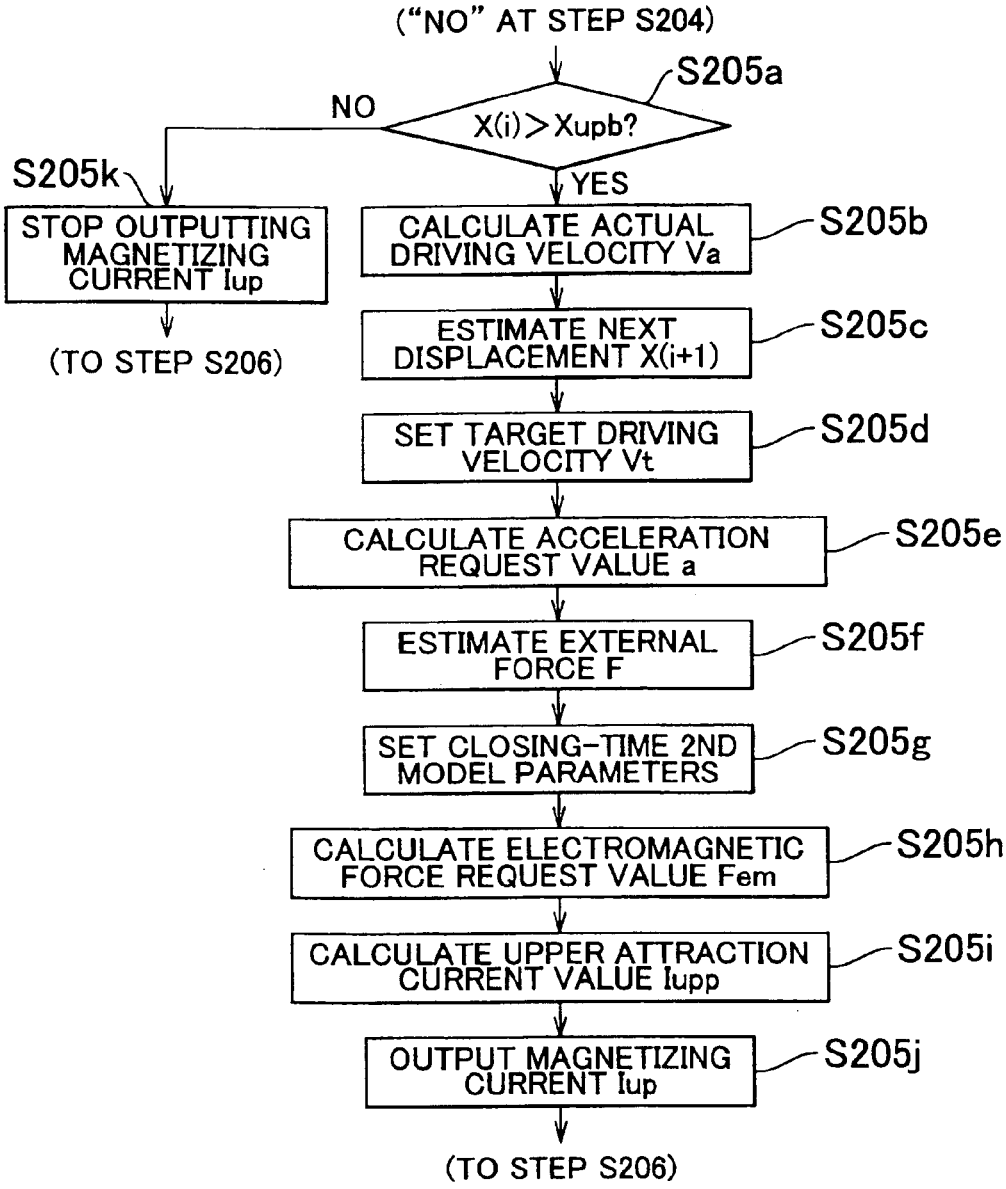
FIG. 10 is a flowchart illustrating a portion of an electromagnetically driven valve opening-time control process in a third embodiment.
Figure 11:
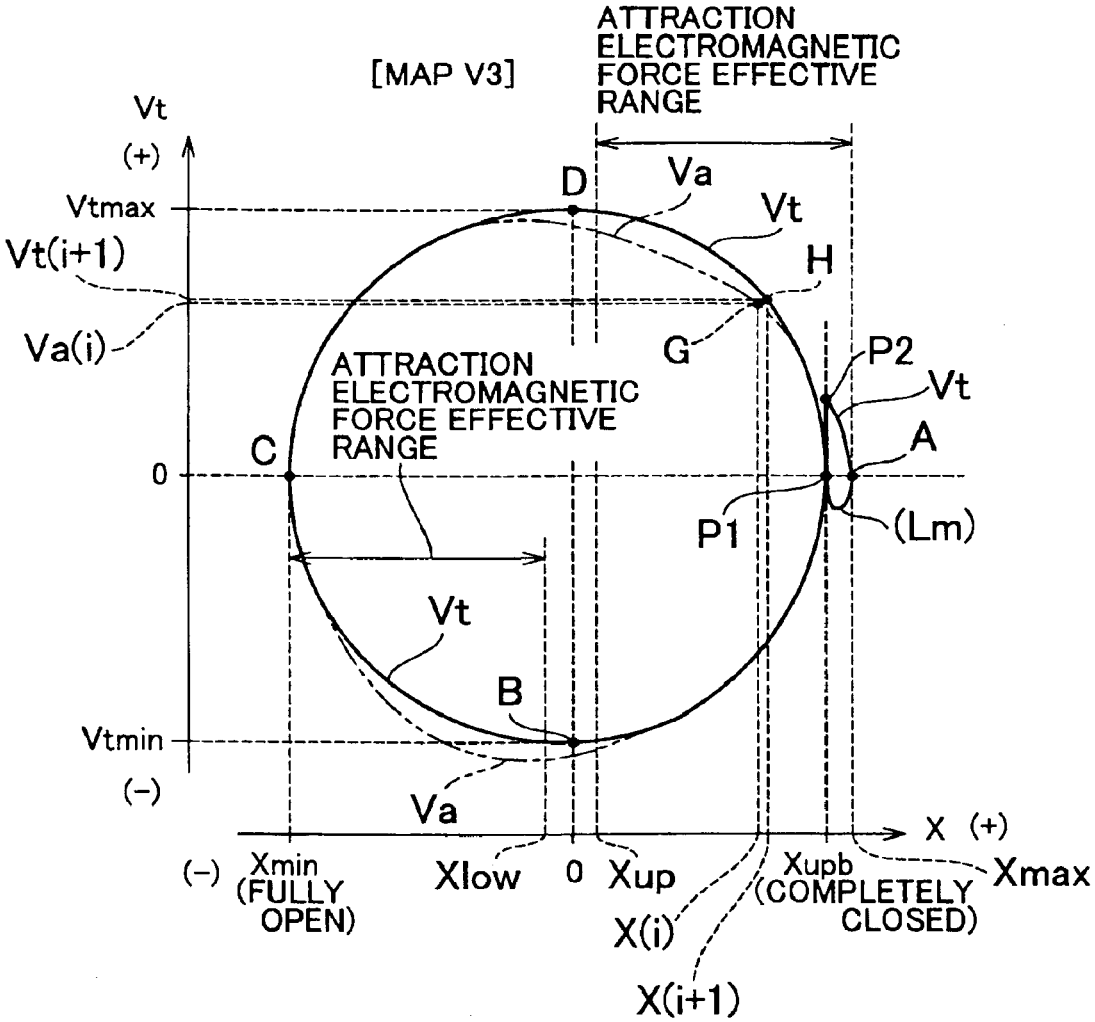
FIG. 11 is an illustration of the arrangement of a map V3 for setting a target driving velocity Vt in the third embodiment.
Figure 12:
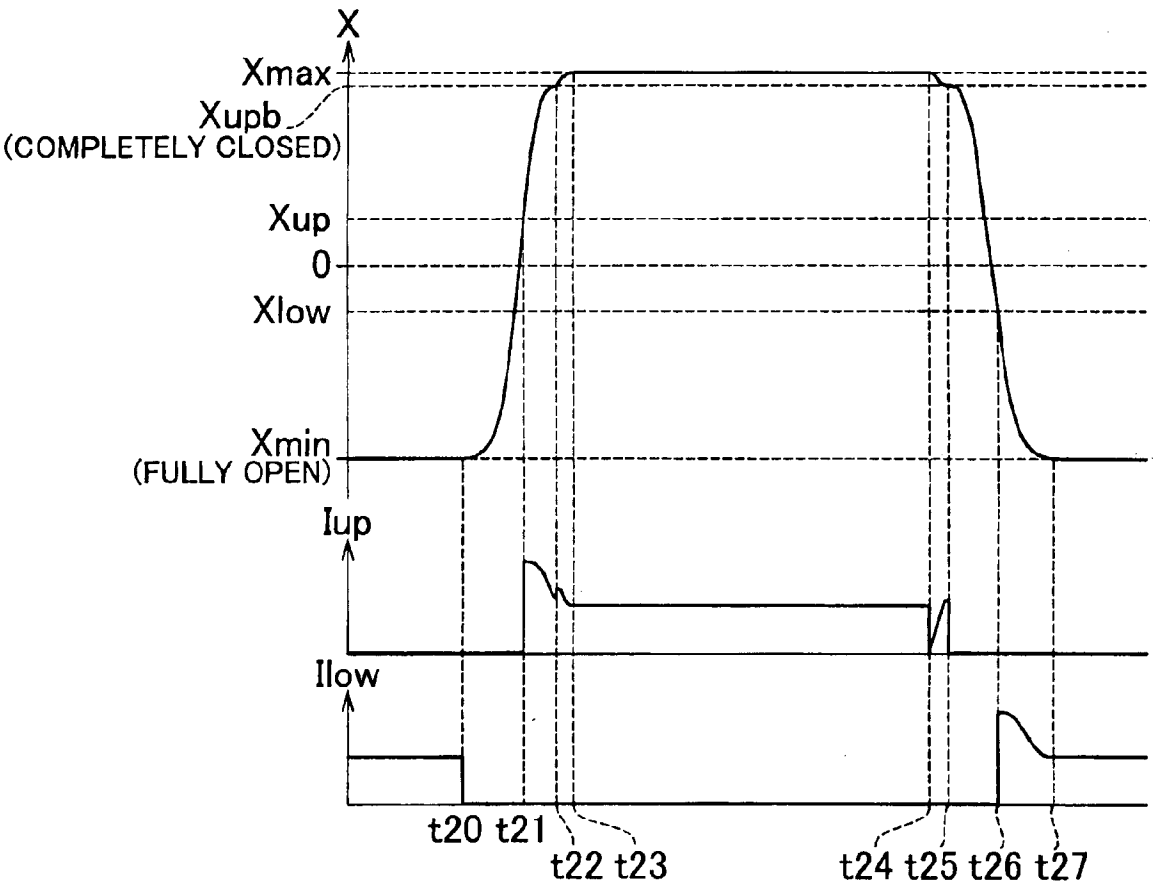
FIG. 12 is a timing chart indicating an example of the driving of the electromagnetically driven valve in the third embodiment.

A third embodiment of the invention will next be described. In the third embodiment, if a negative determination ("NO") is made at step S204 in the electromagnetically driven valve opening-time control process illustrated in FIG. 5, a process illustrated in FIG. 10 is performed prior to execution of step S206. As a map for the target driving velocity Vt, a map V3 as indicated in FIG. 11 is used. In other respects, the third embodiment is the same as the second embodiment. A timing chart illustrating an example of the control of the third embodiment is shown in FIG. 12.

The electromagnetically driven valve opening-time control process (FIGS. 5 and 10) will be described below. This process is executed after a time point (t24 in FIG. 12) at which the supply of current to the upper coil 26*a* is temporarily discontinued due to generation of a valve-opening request. At this time, the armature 22 tends to move apart from the upper core 26 toward the lower core 24 due to the spring force of the upper spring 30. In an initial period of the opening of the valve, the displacement X(i) is greater than the minimum displacement Xmin ("YES" at S202 in FIG. 5), and is also greater than the opening-time passage reference position Xlow ("NO" at S204 in FIG. 5). Therefore, the process illustrated in FIG. 10 is entered.

In the process of FIG. 10, it is determined whether the present displacement X(i) is greater than the boundary value Xupb (S205*a*). In an early period of the valve opening drive, X(i)>Xupb ("YES" at S205*a*). Then, a process of controlling the actual driving velocity Va of the armature 22 to a target driving velocity Vt as indicated by a line Lm between the state A and the state P1 in FIG. 11 by supplying a magnetizing current Iup to the upper coil 26*a* despite the valve-opening drive time is executed (S205*b* to S205*j*). This series of steps (S205*b* to S205*j*) is the same as the process of the steps S108 to S116, S128, and S122 to S126 where the second model parameters are used in the electromagnetically driven valve closing-time control process (FIG. 4). Therefore, after the armature 22 temporarily moves toward the lower core 24 due to the spring force of the upper spring 30 (t24 and later), the armature 22 stops at the position of the boundary value Xupb (t25) due to the effect of electromagnetic force from the upper core 26, as indicated by the line Lm in FIG. 11. That is, the velocity of the armature 22 becomes "0" when the armature 22 contacts the valve body 8. Therefore, the armature 22 can engage with the valve body 8 without producing impact at the time of contact. After the series of steps (S205*b* to S205*j*), the above-described process of steps S206 and S224 is performed, and current is not supplied to the lower coil 24*a*.

Then, after the displacement X(i) reaches the boundary value Xupb ("NO" at S205*a*) following the contact of the armature 22 with the valve body 8, the output of the magnetizing current Iup to the upper coil 26*a* is discontinued (S205*k*, time point t25). Then, the state of discontinuation of the supply of current to the upper coil 26*a* is maintained (S206, S204). After that, the armature 22 and the valve body 8 begin to move together in the engaged state toward the lower core 24 due to the spring force of the combined spring of the lower spring 20 and upper spring 30.

After that, the state where the unit of the armature 22 and the valve body 8 moves toward the lower core 24 due to the combined spring force of the two springs 20, 30 continues (t25 to t26) as long as the displacement X(i) is greater than the opening-time passage reference position Xlow ("NO" at S204, and "NO" at S205*a*). Then, when the displacement X(i) reaches Xlow ("YES" at S204), the magnetizing current Ilow is supplied to the lower coil 24*a*, thus performing the armature 22—attracting control by the lower core 24 (S208 to S222, t26 to t27), and the armature 22—holding control by the lower core 24 (S226, t27 and later).

The process at the time of closing the valve (t20 to t24) is performed as in the above-described electromagnetically driven valve closing-time control process (FIGS. 4 and 7) of the second embodiment.

In the above-described third embodiment, the displacement sensor portion 7 functions as a positional information detection means, and steps S118, S120, S128 in the electromagnetically driven valve closing-time control process (FIGS. 4 and 7) and steps S218, S205*g* (the same as S128) in the electromagnetically driven valve opening-time control process (FIGS. 5 and 10) function as a model parameter changing means.

Furthermore, the electromagnetically driven valve closing-time control process (FIGS. 4 and 7) and the electromagnetically driven valve opening-time control process (FIGS. 5 and 10) excluding steps S118, S120, S128, S218 and S205*g* function as an electromagnetic force adjusting means.

The above-described third embodiment achieves the following advantages.

(a) The advantages (a) and (b) of the second embodiment are achieved.

(b) During the valve-opening drive, the control apparatus of the third embodiment executes both the process of temporarily controlling the actual driving velocity Va of the armature 22 to "0"at the time of contact of the armature 22 with the valve body 8, and the process of controlling the velocity of the unit of the armature 22 and the valve body 8 during movement of the unit and accordingly bringing the unit into the contact with the lower core 24. As for the two processes, by suitably changing the model parameters in accordance with the position of the armature 22, high-precision drive control of the electromagnetically driven valve 2 can be performed. Therefore, impact noise can be remarkably reduced.

A fourth embodiment of the invention will next be described. In the fourth embodiment, one of two spring-mass vibration system models designed beforehand by using different model parameters is selected corresponding to a state change between the state of engagement of the armature 22 and the valve body 8 and the state of disengagement thereof. This operation changes the model parameters for use in the spring-mass vibration system model and therefore the model itself, between the engaged state and the disengaged state of the armature 22 and the valve body 8.

Furthermore, on the basis of the two spring-mass vibration system models for selective adoption, the embodiment uses an observer for observing an internal state. The observer is formed beforehand. The observer is provided for estimating an actual driving velocity Va of the electromagnetically driven valve 2, and for estimating a resultant force of the friction resistance on the sliding portion of the electromagnetically driven valve 2 and the force that acts on the electromagnetically driven valve 2 in accordance with the pressure difference between the in-cylinder pressure and the intake pressure (in the case of an exhaust valve, the difference between the in-cylinder pressure and the exhaust pressure).

The designing of the observer (state observer) carried out beforehand will be described below. First, if the armature 22 and the valve body 8 are in the engaged state as shown in FIG. 2A, the electromagnetically driven valve 2 is modeled as a spring-mass vibration system, and an equation of motion is acquired as in Expression (6).

[Mathematical Expression 6]

$$mp\times\ddot{x}+cp\times\dot{x}+kp\times x=w+u \tag{6}$$

In this expression, mass mp, viscosity coefficient cp and spring constant kp are values provided when the armature 22 and the valve body 8 move in the engaged state, as described above in conjunction with the first embodiment. Furthermore, x represents the amount of displacement of the armature 22, and w represents the external force that acts on the electromagnetically driven valve 2. The external force w is the resultant force of the force fa that acts on the electromagnetically driven valve 2 in accordance with the pressure difference between the in-cylinder pressure and the intake pressure (in the case of an exhaust valve, the difference between the in-cylinder pressure and the exhaust pressure) and the friction resistance fb on the sliding portion of the electromagnetically driven valve 2. Still further in the expression, u represents the control input to the model, that is, the electromagnetic force generated by the lower coil 24*a* and the upper coil 26*a*.

A state variable X is defined as in Expression 7.

[Mathematical Expression 7]

$$X=\begin{bmatrix} x \\ \dot{x} \\ w \end{bmatrix} \tag{7}$$

From Expressions (6) and (7), an equation of state regarding the spring-mass vibration system model of the electromagnetically driven valve 2 is obtained as in Expression (8).

[Mathematical Expression 8]

$$\dot{X}=A\times X+B\times u \tag{8}$$

where $$A=\begin{bmatrix} 0 & 1 & 0 \\ -\frac{kp}{mp} & -\frac{cp}{mp} & \frac{1}{mp} \\ 0 & 0 & 0 \end{bmatrix}$$

$$B=\begin{bmatrix} 0 \\ \frac{1}{mp} \\ 0 \end{bmatrix}$$

With regard to the spring-mass vibration system model of the electromagnetically driven valve 2, an equation of output is expressed as in Expression (9).

[Mathematical Expression 9]

$$Y=C\times X \tag{9}$$

where C=0.

An observer for determining an estimated value Z of the state variable X (hereinafter, referred to as "first observer") is expressed as in Expression (10).

[Mathematical Expression 10]

$$\dot{Z}=A\times Z+B\times u+L\times(Y-C\times Z) \tag{10}$$

$$Z=\begin{bmatrix} \bar{x} \\ \bar{\dot{x}} \\ \bar{w} \end{bmatrix}$$

($\bar{x}$, $\bar{\dot{x}}$, $\bar{w}$ are estimated values of x, $\dot{x}$, w)

In the above expression, L is an observer gain.

If the estimated error (X−Z) between the state variable X and its estimated value Z is written as e, Expression (11) is derived from Expressions (8) to (10).

[Mathematical Expression 11]

$$\dot{e}=(A-L\times C)\times e \tag{11}$$

By suitably designing the observer gain L so that the estimated error e determined by Expression (11) converges to "0", an estimated value Z can be calculated by the first observer expressed by Expression (10). That is, the external force w and the actual driving velocity Va of the electromagnetically driven valve 2 during the period during which the armature 22 and the valve body 8 move in the engaged state can be estimated. Then, by subtracting the electromagnetic force generated by the coils 24*a*, 26*a* from the estimated external force w, the resultant force F based on the aforementioned pressure difference and the friction resistance fb can be estimated.

If the armature 22 moves alone in the state of disengagement of the armature 22 from the valve body 8 as shown in FIG. 2B, the modeling of the electromagnetically driven valve 2 as a spring-mass vibration system will provide an equation of motion as in Expression (12).

[Mathematical Expression 12]

$$ms\times\ddot{x}+cs\times\dot{x}+ks\times(x+xofs)=w+u \tag{12}$$

In this expression, the mass ms, the viscosity coefficient cs and the amount of offset xofs are values provided when the armature 22 moves in the state of disengagement from the valve body 8, as mentioned above in conjunction with the first embodiment. Since the offset xofs is constant, the offset load ks×xofs is also constant. Therefore, if the offset load ks×xofs is subtracted from the right and left-hand sides of Expression (12), the left-hand side becomes the same as Expression (6). Furthermore, if in the right-hand side, the external force w is assumed to include "−ks×xofs", and is expressed as wofs, Expression (12) can be rewritten into Expression (13).

[Mathematical Expression 13]

$$ms\times\ddot{x}+cs\times\dot{x}+ks\times x=wofs+u \quad (13)$$

By performing a process as described above in conjunction with Expressions 6 to 11 through the use of Expression (13), an observer for the case where the armature 22 moves alone (hereinafter, referred to as "second observer") can be designed. Using the second observer, the external force wofs and the actual driving velocity Va of the electromagnetically driven valve 2 during the period where the armature 22 moves alone can be estimated. Furthermore, if the amount of offset "−ks×xofs" and the electromagnetic force generated by the coils 24*a*, 26*a* are subtracted from the estimated external force wofs, the resultant force F of the force fa caused by the differential pressure and the friction resistance fb can be estimated.

Figure 13:
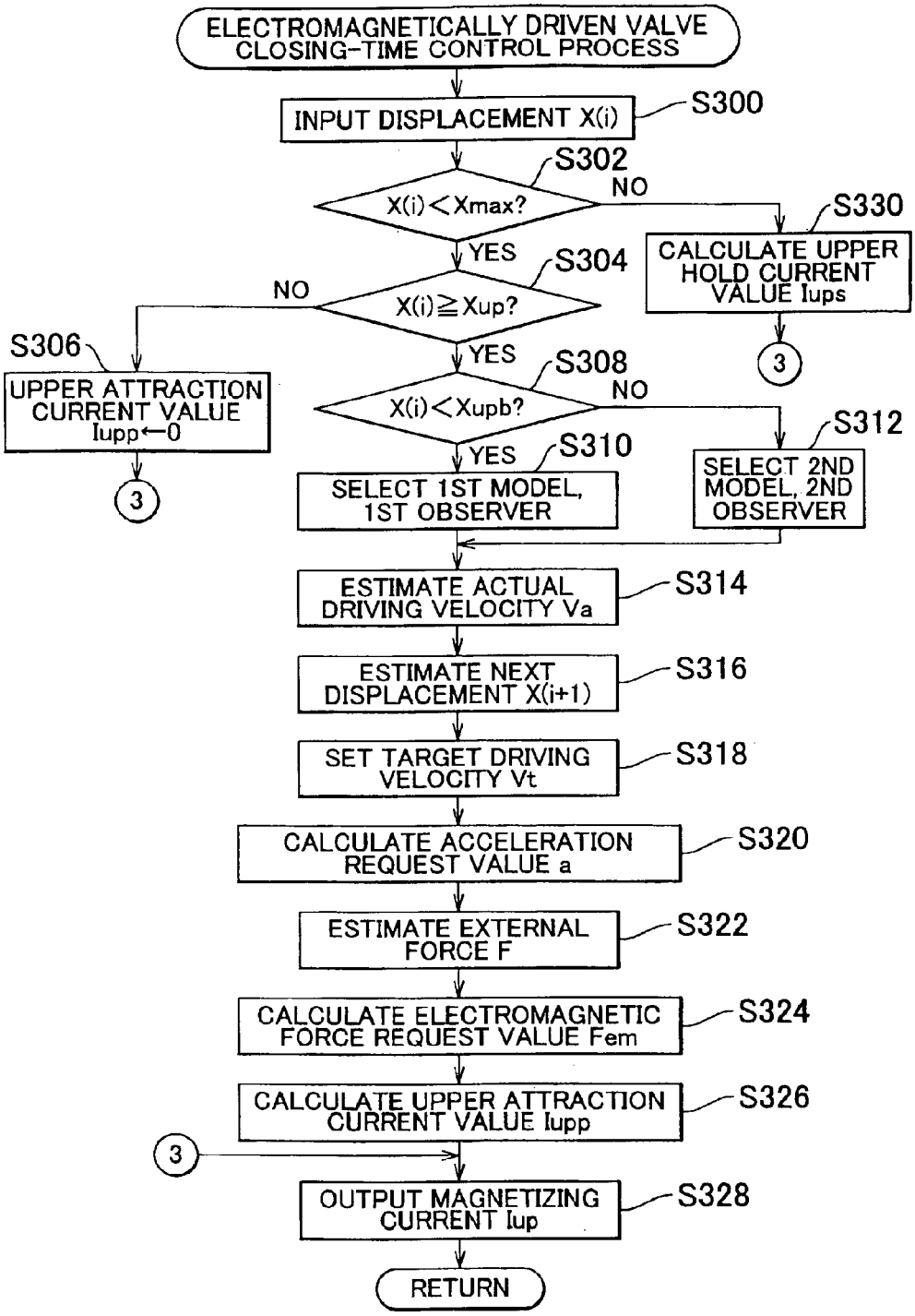
FIG. 13 is a flowchart illustrating an electromagnetically driven valve closing-time control process in a fourth embodiment.
Figure 14:
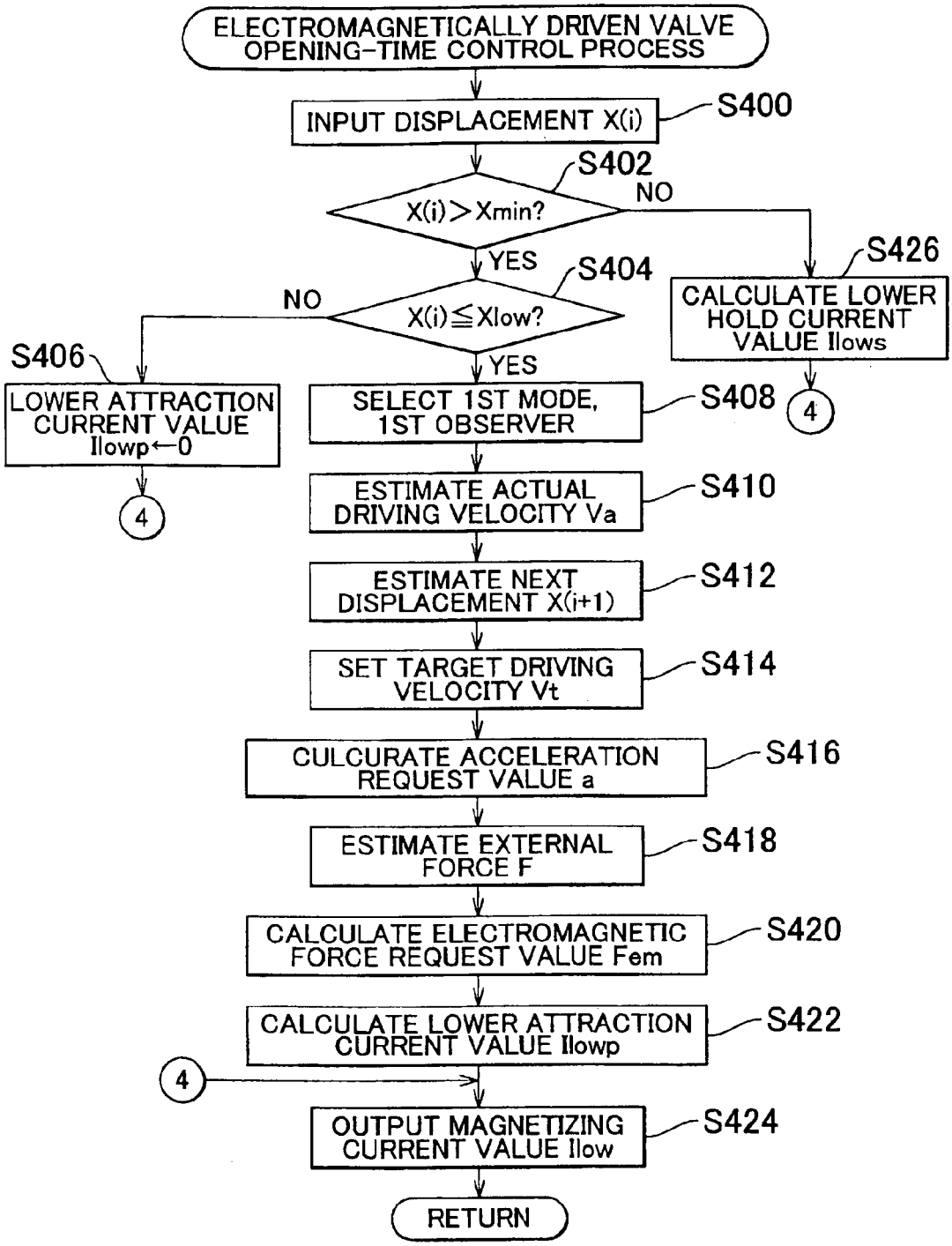
FIG. 14 is a flowchart illustrating an electromagnetically driven valve opening-time control process in the fourth embodiment.

Therefore, in this embodiment, using the first model (Expressions (6)) and the second model (Expression (12)) and the two corresponding observers, the electromagnetically driven valve closing-time control process as illustrated in FIG. 13 is executed instead of the electromagnetically driven valve closing-time control process of the first embodiment. Furthermore, using the first model and the first observer, the electromagnetically driven valve opening-time control process as illustrated in FIG. 14 is executed instead of the electromagnetically driven valve opening-time control process (FIG. 5).

Steps S300 to S306 and steps S326 to S330 in the electromagnetically driven valve closing-time control process (FIG. 13) are the same as steps S100 to S106, and S124, S126 and S130 in FIG. 4. The control process will be described below mainly with regard to the differences from the process illustrated in FIG. 4.

When X(i)≧Xup is satisfied ("YES" at S304) as the displacement X(i) increases, it is then determined whether the displacement X(i) of the armature 22 is less than the boundary value Xupb (S308). The boundary value Xupb represents the amount of displacement that occurs at a boundary regarding whether the armature 22 moves in the state of engagement with the valve body 8 or the state of disengagement from the valve body 8, as mentioned above in conjunction with the first embodiment.

Assuming that X(i)<Xupb ("YES" at S308), the first model and the first observer are selected from the two models and the two observers designed as described above (S310). If X(i)≧Xupb is established ("NO" at S308), the second model and the second observer are selected (S312). That is, if X(i)<Xupb, the first observer and the first model set by the model parameters corresponding to the state where the armature 22 and the valve body 8 are moving together as one unit are selected. Conversely, if X(i)≧Xupb, the second observer and the second model set by the model parameters corresponding to the state where the armature 22 is moving alone are selected.

Then, by the selected observer, the actual driving velocity Va of the armature 22 is estimated as mentioned above (S314). Next, the displacement X(i+1) in the subsequent cycle of control is estimated by Expression (2) (S316). Next, using the map V (FIG. 6), the target driving velocity Vt corresponding to the displacement X(i+1) in the subsequent cycle of control is set (S318). Subsequently, an acceleration request value a is calculated as in Expression (3) (S320). Subsequently, the external force F is estimated by the selected observer, as described above (S322).

An electromagnetic force request value Fem is calculated on the basis of the expression obtained from the selected model (S324). If the first model has been selected, the electromagnetic force request value Fem is calculated on the basis of Expression (14) corresponding to the first model.

[Mathematical Expression 14]

$$Fem\leftarrow mp\times a+CP\times Va(i)+kp\times X(i)-F \quad (14)$$

If the second model has been selected, the electromagnetic force request value Fem is calculated on the basis of Expression (15) corresponding to the second model.

[Mathematical Expression 15]

$$Fem\leftarrow ms\times a+cs\times Va(i)+ks\times(X(i)+xofs)-F \quad (15)$$

Next, in order to output the electromagnetic force request value Fem, the upper attraction current value Iupp to be supplied to the upper coil 26*a* is calculated (S326). The calculation of the upper attraction current value Iupp is performed with reference to the attraction current map of the electromagnetic force request value Fem and the displacement X(i) as described above in conjunction with the first embodiment.

On the basis of the upper attraction current value Iupp determined in this manner, the magnetizing current Iup for the upper coil 26*a* is supplied (S328).

It should be noted that when the displacement X(i) reaches the maximum displacement Xmax ("NO" at S302), the upper hold current value Iups is calculated (S330), and the upper hold current value Iups is output as a magnetizing current Iup (S328). The upper hold current value Iups is as described above in conjunction with the first embodiment.

Next described will be the electromagnetically driven valve opening-time control process (FIG. 14) that is executed after discontinuation of the supply of the magnetizing current Iup to the upper coil 26*a* upon the valve opening request. In the control process, steps S400 to S406, and S422 to S426 are the same as steps S200 to S206, and S222 to S226 in FIG. 5. The control process will be described below mainly with regard to the differences from the process illustrated in FIG. 5.

When the displacement X(i) becomes equal to or less than the opening-time passage reference position Xlow ("YES" at S404), the first observer and the first model are selected (S408). Therefore, the subsequent estimation of the actual driving velocity Va of the armature 22 is performed by the selected first observer (S410).

Next, the displacement X(i+1) in the subsequent cycle of control is estimated by Expression (2) (S412). Next, using the map V (FIG. 6), the target driving velocity Vt corresponding to the displacement X(i+1) in the subsequent cycle of control is set (S414). Subsequently, an acceleration request value a is calculated as in Expression (3) (S416). Subsequently, the external force F is estimated by the selected first observer, as described above (S418).

Then, the electromagnetic force request value Fem is calculated as in Expression (14) corresponding to the first model (S420). After that, the process of steps S422 and S424 is executed.

In the above-described fourth embodiment, the displacement sensor portion 7 functions as a positional information detection means, and steps S308 to S312, and S408 function as a model parameter changing means. Furthermore, the processes of FIGS. 13 and 14 excluding steps S308 to S312, and S408 function as an electromagnetic force adjusting means.

The above-described fourth embodiment achieves the following advantages.

(a) A suitable model (specifically, a suitable calculation expression for the electromagnetic force request value Fem) and an observer are selected (S310, S312, S408) by determining which one of the period during which the armature 22 is moving in the state of engagement with the valve body 8 and the period during which the armature 22 is moving alone in the state of disengagement from the valve body 8 is concerned on the basis of information regarding the position of the armature 22. Therefore, it is possible to always suitably use a model based on the model parameters corresponding to changes in the actual spring-mass vibration system. Hence, the precision in controlling the electromagnetically driven valve 2 using a model can be improved.

(b) A model is selected from the group of models in which all of the mass, the viscosity coefficient, the spring constant and the offset are set corresponding to various states of spring-mass vibration systems. Therefore, it is possible to set sufficiently precise models corresponding to changes in the actual spring-mass system. Hence, the precision in controlling the electromagnetically driven valve 2 can be considerably improved.

(c) Since the external force F is estimated by an observer, it is unnecessary to measure the pressure difference between the in-cylinder pressure and the intake pressure (exhaust pressure in the case of an exhaust valve) that acts on the electromagnetically driven valve 2. Therefore, the construction of the sensors 34 can be simplified.

Although in the foregoing embodiments, the armature 22 is allowed to contact the upper core 26 during the valve-closing drive after the valve body 8 contacts the valve seat 16, it is also possible to prevent the armature 22 from contacting the upper core 26 after separation of the armature 22 from the valve body 8. That is, the electromagnetic force generated by the upper coil 26*a* may be adjusted so as to stop the armature 22 in a generally termed suspended state where there is a gap between the armature 22 and the upper core 26. In such a suspended control, too, the changing of model parameters and the selection of a model are suitably performed, so that high-precision drive control can be achieved. Hence, impact noise at the time of closure of the valve can be precisely prevented.

It is also possible to prevent the armature 22 from contacting the lower core 24 during the valve-opening drive as well. That is, the armature 22 may be stopped in the suspended state with a small gap left between the armature 22 and the lower core 24, by adjusting the electromagnetic force generated by the lower coil 24*a*. This arrangement allows total avoidance of impact of the armature 22 on the lower core 24. In this suspended control, too, the changing of model parameters and the selection of a model are suitably performed, so that high-precision drive control can be achieved. Hence, impact noise during the opening of the valve can be precisely prevented.

Although in the first to third embodiments, all the parameters of mass, viscosity coefficient, spring constant and offset of spring are changed in accordance with the engagement and the disengagement between the armature 22 and the valve body 8, it is also possible to change one of the model parameters, or two or three of the model parameters.

For example, if the amount of offset of the upper spring 30 is small, or if the amount of offset thereof has only small effect on the control relative to the other parameters, it is also possible to omit the changing of the amount of offset and perform the changing of only the parameters of mass, viscosity coefficient and spring constant. Furthermore, if the mass of the valve body 8 is considerably small relative to the armature 22, or if the entire mass including the mass of the armature 22 is small so as to have only small effect on the control relative to the other parameters, it is also possible to omit the changing of the parameter of mass and perform the changing of only the parameters of viscosity coefficient, spring constant and offset. Still further, if the viscosity coefficient based on motion of the valve body 8 is considerably small relative to that based on the motion of the armature 22, or if the entire viscosity coefficient including the viscosity coefficient based on the motion of the armature 22 is small so as to have only small effect on the control relative to the other parameters, it is also possible to omit the changing of the parameter of viscosity coefficient and perform the changing of only the parameters of mass, spring constant and offset. Further, if the spring constant of the lower spring 20 is smaller than that of the upper spring 30, or if the spring constant itself, including the spring constant of the upper spring 30, is small so as to have only small effect on the control relative to the other parameters, it is also possible to omit the changing of the parameter of spring constant and perform the changing of only the parameters of mass, viscosity coefficient and offset. If two of the model parameters of mass, viscosity coefficient, spring constant and offset have particularly great effect on the control, it is also possible to perform the changing with respect to these two model parameters and omit the changing of the other two model parameters. If one of the model parameters of mass, viscosity coefficient, spring constant and offset has particularly great effect on the control, it is also possible to perform the changing with respect to that model parameter and omit the changing of the other three model parameters.

Furthermore, if the mass of the lower spring 20 or the upper spring 30 is smaller than the masses of other movable portions, such as the mass of the armature 22 or the valve body 8, and particularly the mass of the armature 22, it is also possible to reflect only the masses of the armature 22 and the valve body 8 in the parameter of mass.

A similar arrangement may also be applied to the case of setting an observer that reflects a model of the foregoing fourth embodiment or an expression for calculating an electromagnetic force request value Fem. That is, with regard to all the parameters of mass, viscosity coefficient, spring constant and the offset of spring, suitable one or more of the parameters may be selected in accordance with the engagement or disengagement of the armature 22 and the valve body 8, for use in the setting of a calculating expression for an electromagnetic force request value Fem or an observer. Furthermore, as for the model parameters used for the setting, it is also possible to set only one of the model parameters to as an object of selection, or set only two or three of the model parameters as objects of selection.

Although the first to third embodiments execute the changing of model parameters in the model represented by Expression (5), it is also possible to perform a process of selecting a model in step S120, S128, S218, S205*g*. That is, in step S120, S218, Expression (14) may be selected for use. In step S128, S205*g*, Expression (5) may be selected for use.

Although in the foregoing embodiments, the electromagnetically driven valve 2 is used as an intake valve or an exhaust valve of an internal combustion engine, the invention is also applicable to other types of open-close valves.

In the illustrated embodiment, a controller (the ECU 32) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. An electromagnetically driven valve control apparatus for an electromagnetically driven valve which has a movable element that is driven by cooperation of a spring force and an electromagnetic force, and a valve body engageable with the movable element, and which causes an open-close motion of the valve body due to the movable element engaging with the valve body in accordance with the driving of the movable element, comprising:

a controller which detects positional information regarding the movable element, and which performs adjustment of an electromagnetic force for driving the movable element so that the movable element reaches a target operation state based on the positional information detected and a model of the electromagnetically driven valve obtained as a spring-mass vibration system, wherein the controller determines whether the movable element is operating in a first state in which the movable element is engaged with the valve body or in a second state in which the movable element is disengaged from the valve body based on the positional information detected, and wherein the controller sets a modes parameter regarding mass based on a total mass of the movable element and the valve body if the determined state is the first state, and the controller changes the model parameter regarding mass by setting the model parameter regarding mass based on a mass of the movable element without the mass of the valve body if the determined state is the second state.

2. The electromagnetically driven valve control apparatus according to claim 1, wherein in the electromagnetically driven valve, the movable element is urged by a first spring in such a direction as to move the valve body toward an open side, and the valve body is urged toward a closed side by a second spring.

3. The electromagnetically driven valve control apparatus according to claim 2, wherein the controller sets the model parameter regarding mass based on a total mass of the movable element, the valve body, the first spring and the second spring if the determined state is the first state, and the controller changes the model parameter regarding mass by setting the model parameter regarding mass based on a mass of the movable element and the first spring without the mass of the valve body and the second spring if the determined state is the second state.

4. The electromagnetically driven valve control apparatus according to claim 2, wherein the controller changes a model parameter regarding spring constant corresponding to the determined state.

5. The electromagnetically driven valve control apparatus according to claim 4, wherein the controller sets the model parameter regarding spring constant based on a spring constant of a combined spring of the first spring and the second spring if the determined state is the first state, and the controller changes the model parameter regarding spring constant by setting the model parameter regarding spring constant based on a spring constant of the first spring without a spring constant of the second spring if the determined state is the second state.

6. The electromagnetically driven valve control apparatus according to claim 2, wherein the controller changes a model parameter regarding spring constant and a model parameter regarding offset of spring corresponding to the determined state.

7. The electromagnetically driven valve control apparatus according to claim 6, wherein the controller sets the model parameter regarding spring constant and the model parameter regarding offset based on a spring constant of a combined spring of the first spring and the second spring and an offset of the combined spring if the determined state is the first state, and the controller changes the model parameter regarding spring constant and the model parameter regarding offset by setting the model parameter regarding spring constant and the model parameter regarding offset based on a spring constant of the first spring and an offset of the first spring without the spring constant and offset of the second spring if the determined state is the second state.

8. The electromagnetically driven valve control apparatus according to claim 2, wherein the controller changes a model parameter regarding viscosity coefficient corresponding to the determined state.

9. The electromagnetically driven valve control apparatus according to claim 8, wherein the controller sets the model parameter regarding viscosity coefficient based on a total viscosity coefficient of a viscosity coefficient related to motion of the movable element and a viscosity coefficient related to motion of the valve body if the determined state is the first state, and the controller changes the model parameter regarding viscosity coefficient by setting the model parameter regarding viscosity coefficient based on the viscosity coefficient related to motion of the movable element without the viscosity coefficient related to motion of the valve body if the determined state is the second state.

10. The electromagnetically driven valve control apparatus according to claim 2, wherein the controller changes, in addition to the model parameter regarding mass, a model parameter regarding physical quantity that involves any one, two, or three additional physical quantities selected from the group consisting of spring constant, offset of spring and viscosity coefficient corresponding to the determined state.

11. The electromagnetically driven valve control apparatus according to claim 10, wherein the controller sets the model parameter regarding the physical quantity based on a physical quantity obtained from a combination of the physical quantity regarding the movable element and the physical quantity regarding the valve body if the determined state is the first state, and the controller changes the model parameter regarding the physical quantity by setting the model parameter regarding the physical quantity based on the physical quantity regarding the movable element without the physical quantity regarding the valve body if the determined state is the second state.

12. The electromagnetically driven valve control apparatus according to claim 1, wherein the controller changes a model parameter regarding viscosity coefficient corresponding to the determined state.

13. The electromagnetically driven valve control apparatus according to claim 12, wherein the controller sets the model parameter regarding viscosity coefficient based on a total viscosity coefficient of a viscosity coefficient related to motion of the movable element and a viscosity coefficient related to motion of the valve body if the determined state is the first state, and the controller changes the model parameter regarding viscosity coefficient by setting the model parameter regarding viscosity coefficient based on the viscosity coefficient related to motion of the movable element without the viscosity coefficient related to motion of the valve body if the determined state is the second state.

14. A method of controlling an electromagnetically driven valve which has a movable element that is driven by cooperation of a spring force and an electromagnetic force, and a valve body engageable with the movable element, and which causes an open-close motion of the valve body due to the movable element engaging with the valve body in accordance with the driving of the movable element, the method comprising:

detecting positional information regarding the movable element;

performing adjustment of an electromagnetic force for driving the movable element so that the movable element reaches a target operation state based on the positional information detected and a model of the electromagnetically driven valve obtained as a spring-mass vibration system;

determining whether the movable element is operating in a first state in which the movable element is engaged with the valve body or in a second state in which the movable element is disengaged from the valve body based on the positional information detected; and setting a model parameter regarding mass based on a total mass of the movable element and the valve body if the determined state is the first state, and setting the model parameter regarding mass based on a mass of the movable element without the mass of the valve body if the determined state is the second state.

15. The method according to claim 14, wherein in the electromagnetically driven valve, the movable element is urged by a first spring in such a direction as to move the valve body toward an open side, and the valve body is urged toward a closed side by a second spring.

16. The method according to claim 15, wherein the model parameter regarding mass is set based on a total mass of the movable element, the valve body, the first spring and the second spring if the determined state is the first state, and the model parameter regarding mass is set based on a mass of the movable element and the first spring without the mass of the valve body and the second spring if the determined state is the second state.

17. The method according to claim 15, further comprising changing a model parameter regarding spring constant based upon the determined state.

18. The method according to claim 17, wherein the model parameter regarding spring constant is set based on a spring constant of a combined spring of the first spring and the second spring if the determined state is the first state, and the model parameter regarding spring constant is set based on a spring constant of the first spring without a spring constant of the second spring if the determined state is the second state.

19. The method according to claim 15, further comprising changing a model parameter regarding spring constant and a model parameter regarding offset of spring based upon the determined state.

20. The method according to claim 19, wherein the model parameter regarding spring constant and the model parameter regarding offset are set based on a spring constant of a combined spring of the first spring and the second spring and an offset of the combined spring if the determined state is the first state, and the model parameter regarding spring constant and the model parameter regarding offset are set based on a spring constant of the first spring and an offset of the first spring without the spring constant and offset of the second spring if the determined state is the second state.

21. The method according to claim 15, further comprising changing a model parameter regarding viscosity coefficient based upon the determined state.

22. The method according to claim 21, wherein the model parameter regarding viscosity coefficient is set based on a total viscosity coefficient of a viscosity coefficient related to motion of the movable element and a viscosity coefficient related to motion of the valve body if the determined state is the first state, and the model parameter regarding viscosity coefficient is set based on the viscosity coefficient related to motion of the movable element without the viscosity coefficient related to motion of the valve body if the determined state is the second state.

23. The method according to claim 15, further comprising changing, in addition to the model parameter regarding mass, a model parameter regarding a physical quantity that involves any one, two, or three additional physical quantities selected from the group consisting of spring constant, offset of spring and viscosity coefficient based upon the determined state.

24. The method according to claim 23, wherein the model parameter regarding the physical quantity is set based on a physical quantity obtained from a combination of the physical quantity regarding the movable element and the physical quantity regarding the valve body if the determined state is the first state, and the model parameter regarding the physical quantity is set based on the physical quantity regarding the movable element without the physical quantity regarding the valve body if the determined state is the second state.

25. The method according to claim 14, further comprising changing a model parameter regarding viscosity coefficient based upon the determined state.

26. The method according to claim 25, wherein the model parameter regarding viscosity coefficient is set based on a total viscosity coefficient of a viscosity coefficient related to motion of the movable element and a viscosity coefficient related to motion of the valve body if the determined state is the first state, and the model parameter regarding viscosity coefficient is set based on the viscosity coefficient related to motion of the movable element without the viscosity coefficient related to motion of the valve body if the determined state is the second state.

* * * * *